US010563377B2

(12) United States Patent
Kishida et al.

(10) Patent No.: US 10,563,377 B2
(45) Date of Patent: Feb. 18, 2020

(54) HYDRAULIC PUMP CONTROL SYSTEM OF HYDRAULIC WORKING MACHINE

(71) Applicant: Caterpillar SARL, Geneva (CH)

(72) Inventors: Kouji Kishida, Hyogo (JP); Yoshihiko Hata, Hyogo (JP); Nobuaki Matoba, Hyogo (JP)

(73) Assignee: Caterpillar SARL, Geneva (CH)

( * ) Notice: Subject to any disclaimer, the term of this patent is extended or adjusted under 35 U.S.C. 154(b) by 0 days.

(21) Appl. No.: 15/754,676

(22) PCT Filed: Sep. 16, 2016

(86) PCT No.: PCT/EP2016/072076
§ 371 (c)(1),
(2) Date: Feb. 23, 2018

(87) PCT Pub. No.: WO2017/046401
PCT Pub. Date: Mar. 23, 2017

(65) Prior Publication Data

US 2018/0238027 A1 Aug. 23, 2018

(30) Foreign Application Priority Data

Sep. 16, 2015 (JP) ..... 2015-183162
Sep. 16, 2015 (JP) ..... 2015-183163

(51) Int. Cl.
*E02F 9/22* (2006.01)
*F15B 11/16* (2006.01)

(52) U.S. Cl.
CPC ..... *E02F 9/2228* (2013.01); *E02F 9/2232* (2013.01); *E02F 9/2235* (2013.01);
(Continued)

(58) Field of Classification Search
CPC ..... E02F 9/2282; F15B 11/165; F15B 11/166; F15B 2211/3116; F15B 2211/45; F15B 2211/20553
See application file for complete search history.

(56) References Cited

U.S. PATENT DOCUMENTS 8,424,301 B2 * 4/2013 Choi ..... B66C 23/44 60/421
8,899,035 B2 * 12/2014 Nishikawa ..... E02F 9/2235 60/445

(Continued)

FOREIGN PATENT DOCUMENTS

EP 0533953 A1 3/1993
EP 2418390 A1 2/2012

OTHER PUBLICATIONS

International Search Report for related International Application No. PCT/EP2016/072076; report dated Jun. 12, 2016.

*Primary Examiner* — Thomas E Lazo
*Assistant Examiner* — Michael Quandt

(57) ABSTRACT

A hydraulic working machine is provided that uses a variable displacement pump and open center type flow rate control valve for a controlling a hydraulic actuator, and has a negative control throttle disposed in a center bypass oil passage to generate a negative control pressure. A hydraulic pump control system performs virtual bleed-off control for reducing the bleed-off flow rate of the center bypass oil passage, and can operate the hydraulic actuator with the same performance as an open center control. The control system includes a bypass cut valve disposed upstream from the negative control throttle to reduce flow through the center bypass oil passages, and a negative control pressure output valve that outputs a virtual negative control pressure. The control system is configured to reduce the bleed-off flow rate by operating the bypass cut valve when virtual bleed-off
(Continued)

control is performed, and to reduce the pump flow rate by the bleed-off reduction flow rate.

9 Claims, 20 Drawing Sheets

(52) U.S. Cl.
CPC ..... *E02F 9/2267* (2013.01); *E02F 9/2271* (2013.01); *E02F 9/2282* (2013.01); *E02F 9/2296* (2013.01); *F15B 11/165* (2013.01); *E02F 9/2242* (2013.01); *E02F 9/2292* (2013.01); *F15B 11/166* (2013.01); *F15B 2211/20553* (2013.01); *F15B 2211/20576* (2013.01); *F15B 2211/3116* (2013.01); *F15B 2211/40507* (2013.01); *F15B 2211/40515* (2013.01); *F15B 2211/41554* (2013.01); *F15B 2211/426* (2013.01); *F15B 2211/45* (2013.01); *F15B 2211/50518* (2013.01); *F15B 2211/5156* (2013.01); *F15B 2211/7135* (2013.01); *F15B 2211/7142* (2013.01)

(56) References Cited

U.S. PATENT DOCUMENTS

| | | | | |
|---|---|---|---|---|
| 9,103,095 | B2 * | 8/2015 | Nishikawa | E02F 9/2228 |
| 9,109,346 | B2 * | 8/2015 | Yoshino | E02F 9/2235 |
| 9,249,812 | B2 * | 2/2016 | Jeon | E02F 9/2232 |
| 10,066,610 | B2 * | 9/2018 | Yamada | E02F 9/2235 |
| 2010/0018197 | A1 * | 1/2010 | Yoo | B66C 23/44 60/420 |
| 2011/0072810 | A1 | 3/2011 | Kawasaki et al. | |
| 2013/0333367 | A1 * | 12/2013 | Jeon | E02F 9/2232 60/328 |

* cited by examiner

[Fig 1]
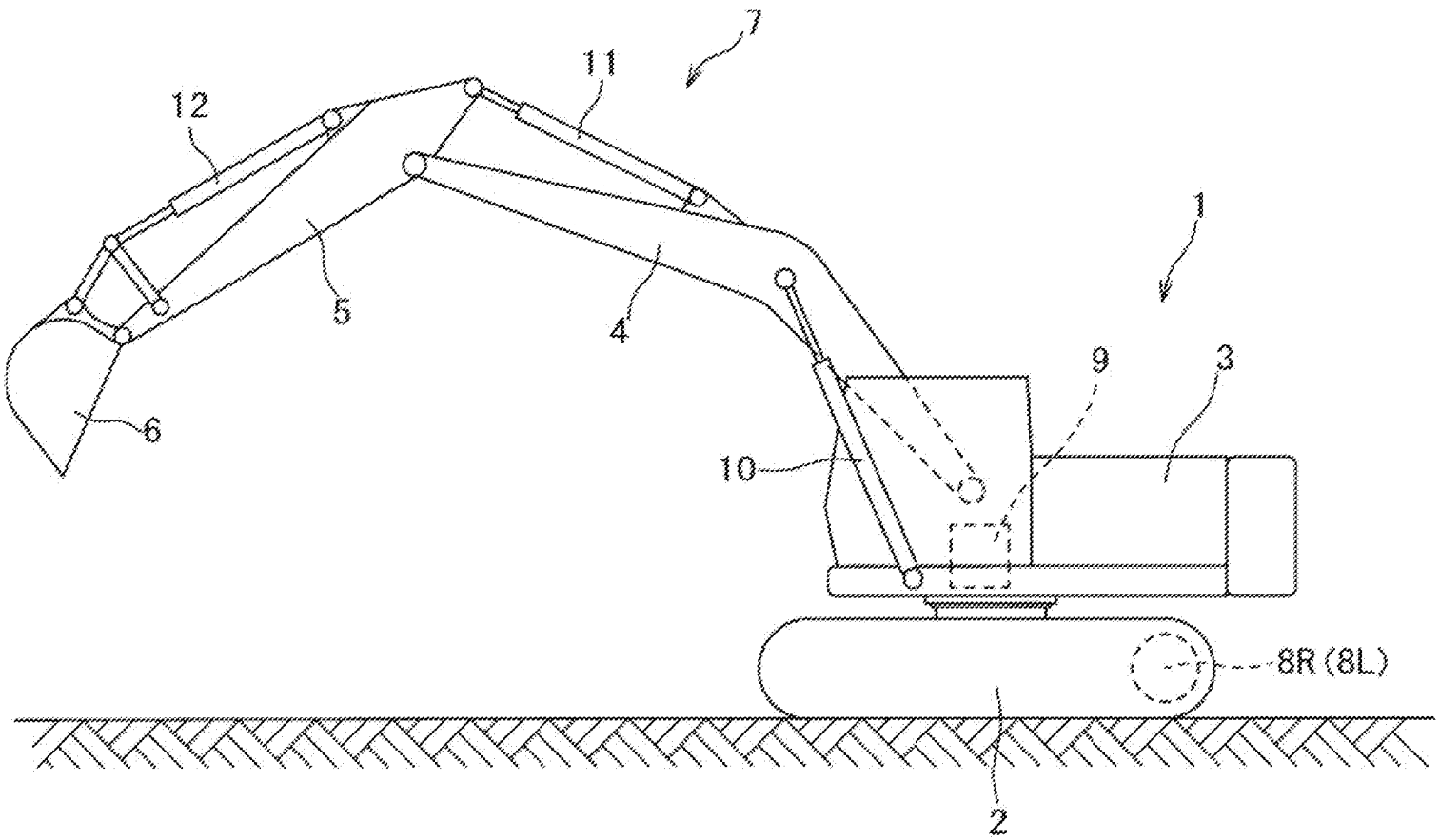

[Fig 2]
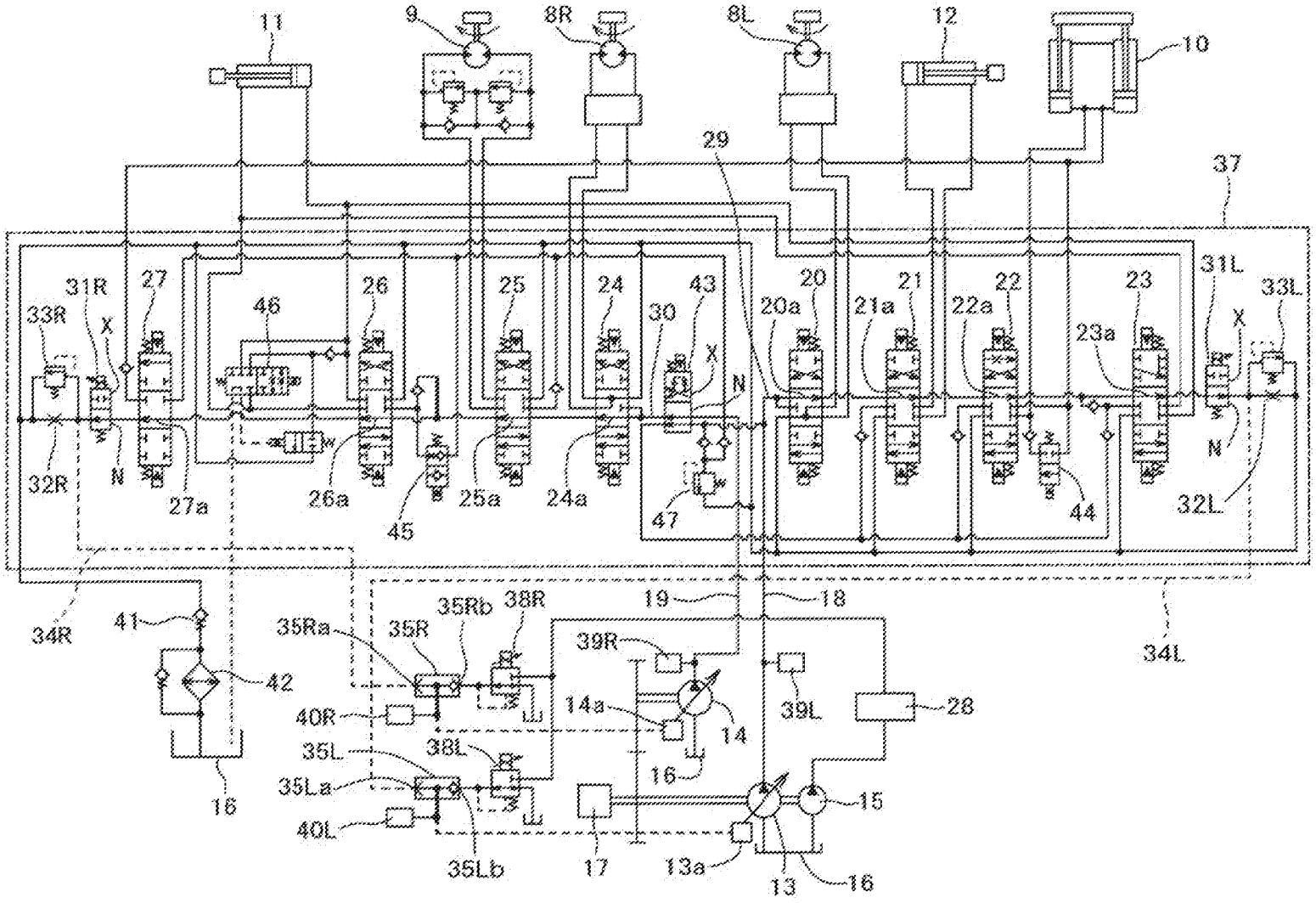

[Fig 3]
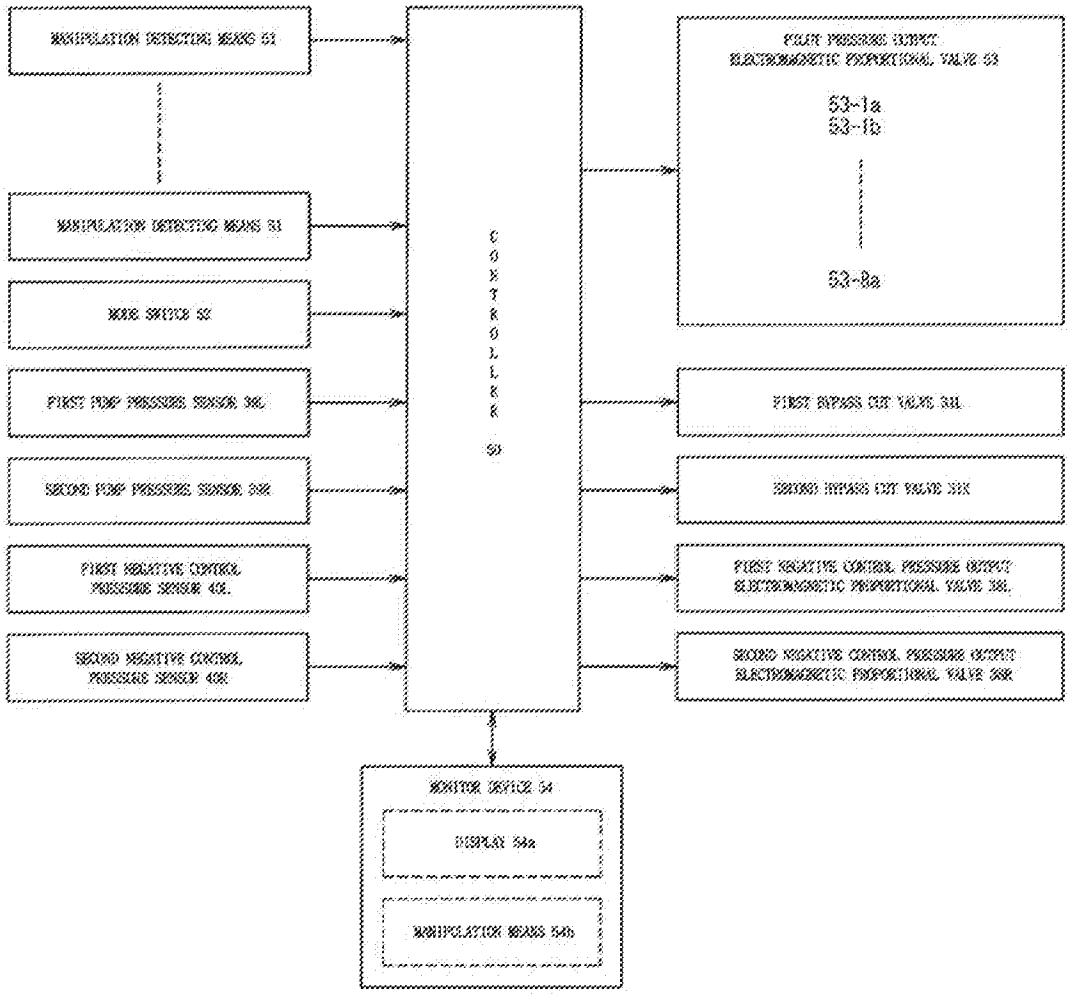

[Fig 4]
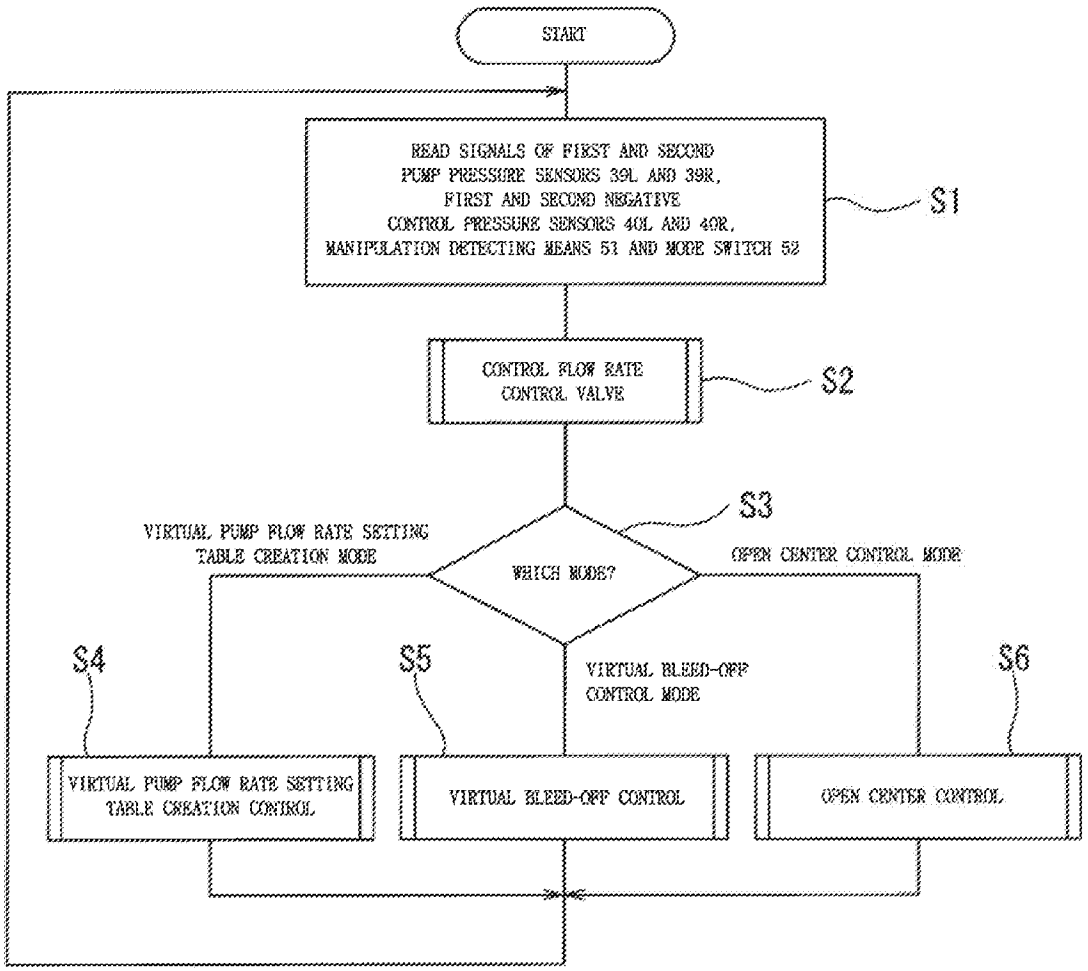

[Fig. 5]
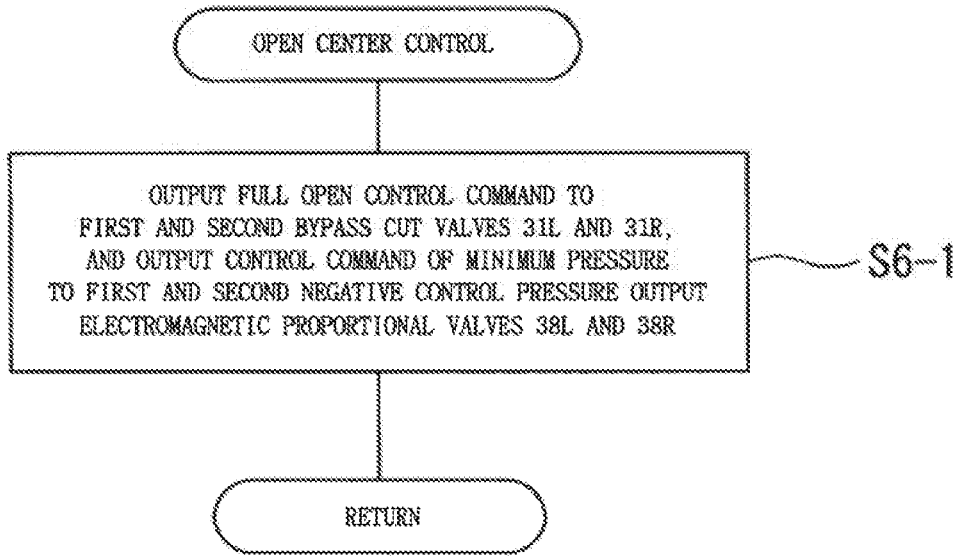

[Fig. 6]
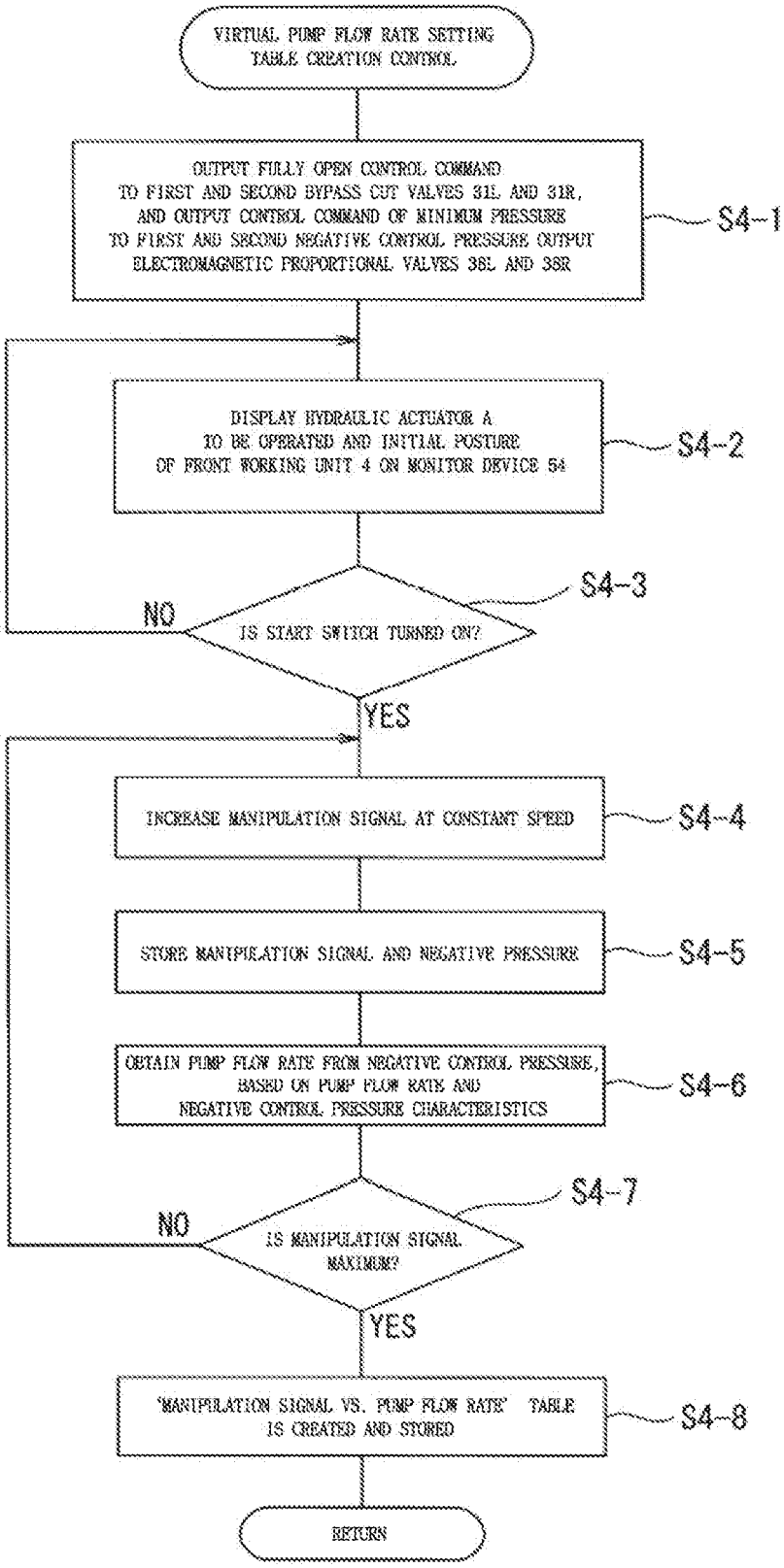

[Fig 7]
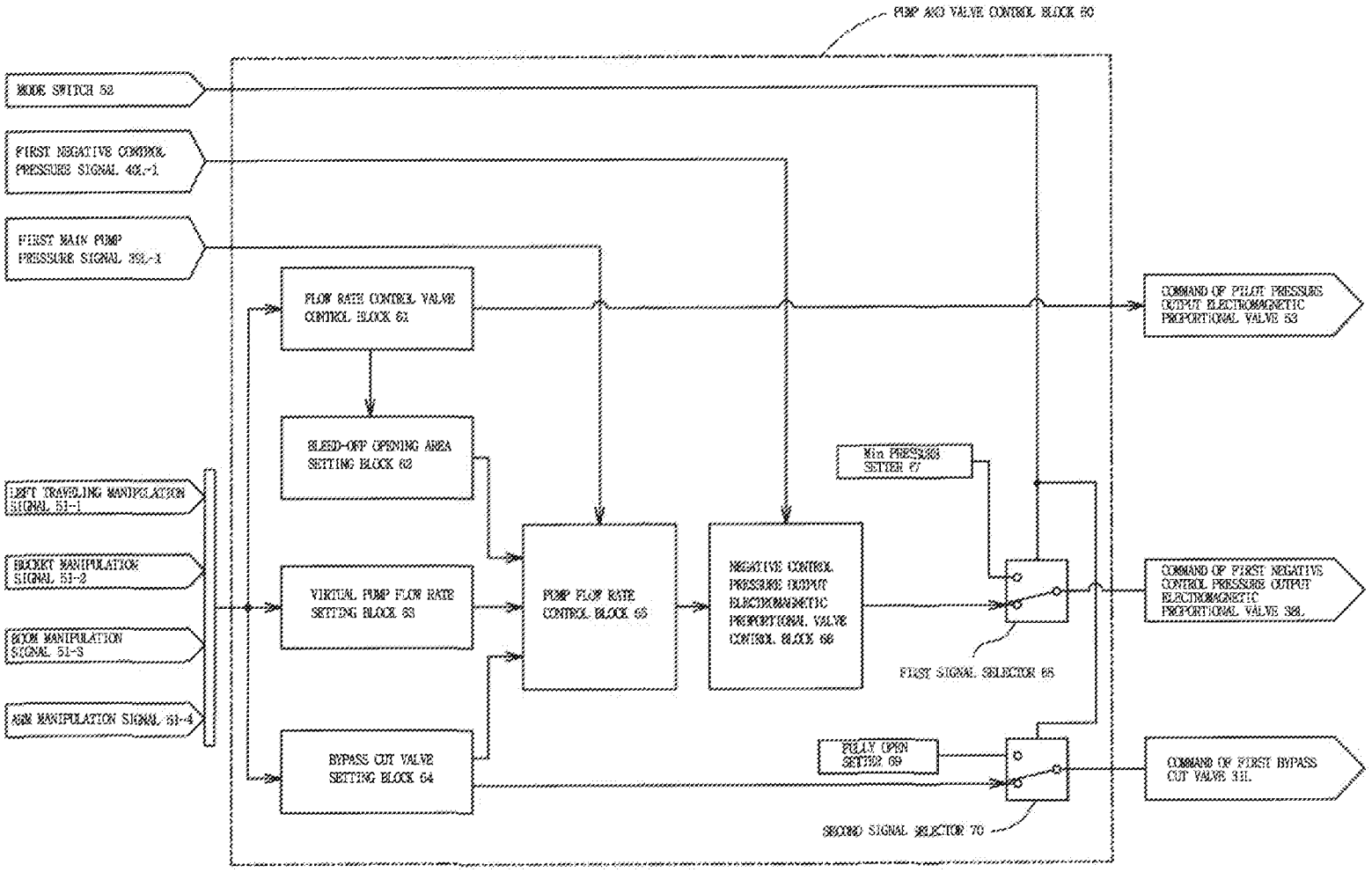

[Fig 8]
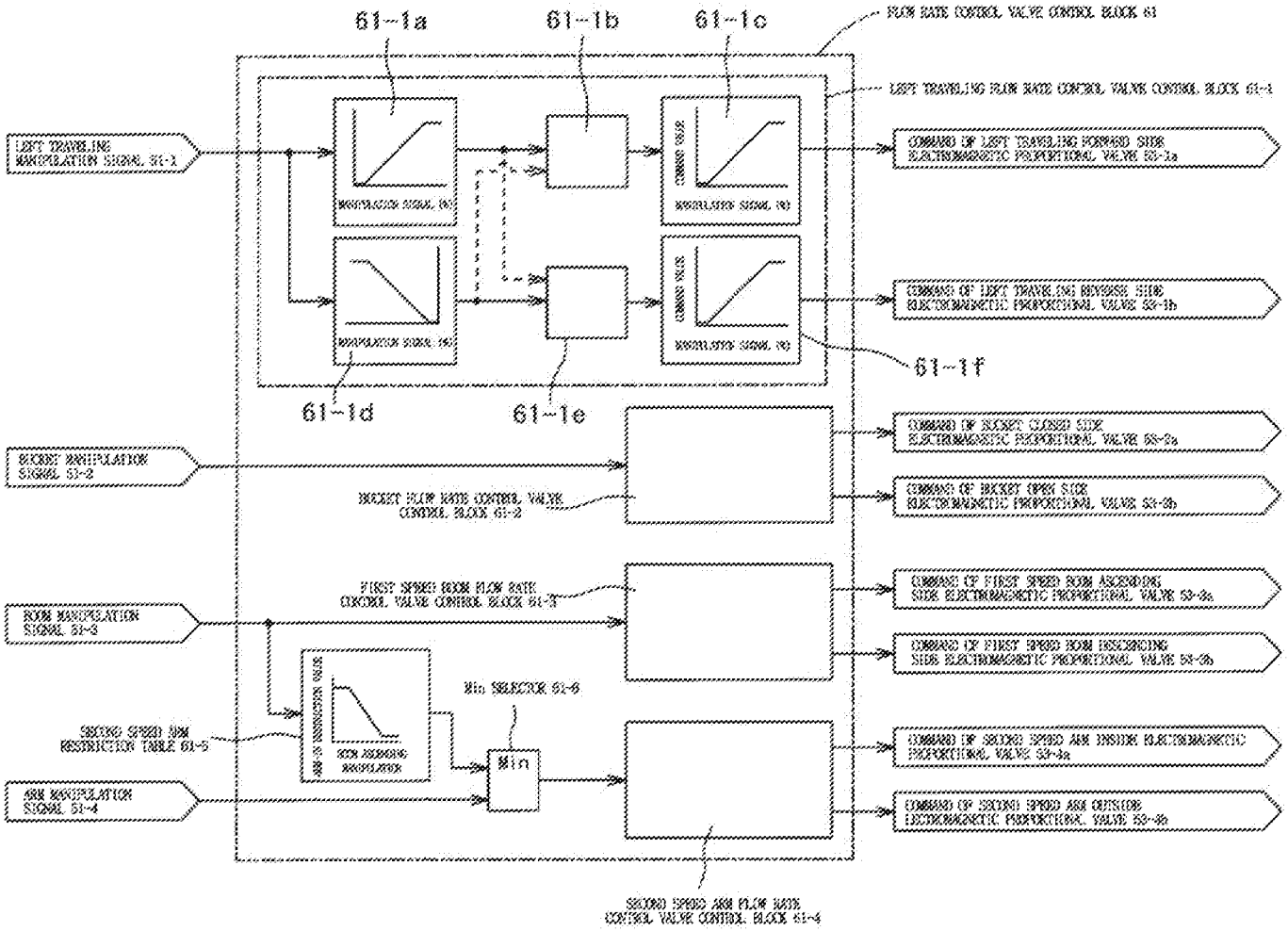

[Fig 9]
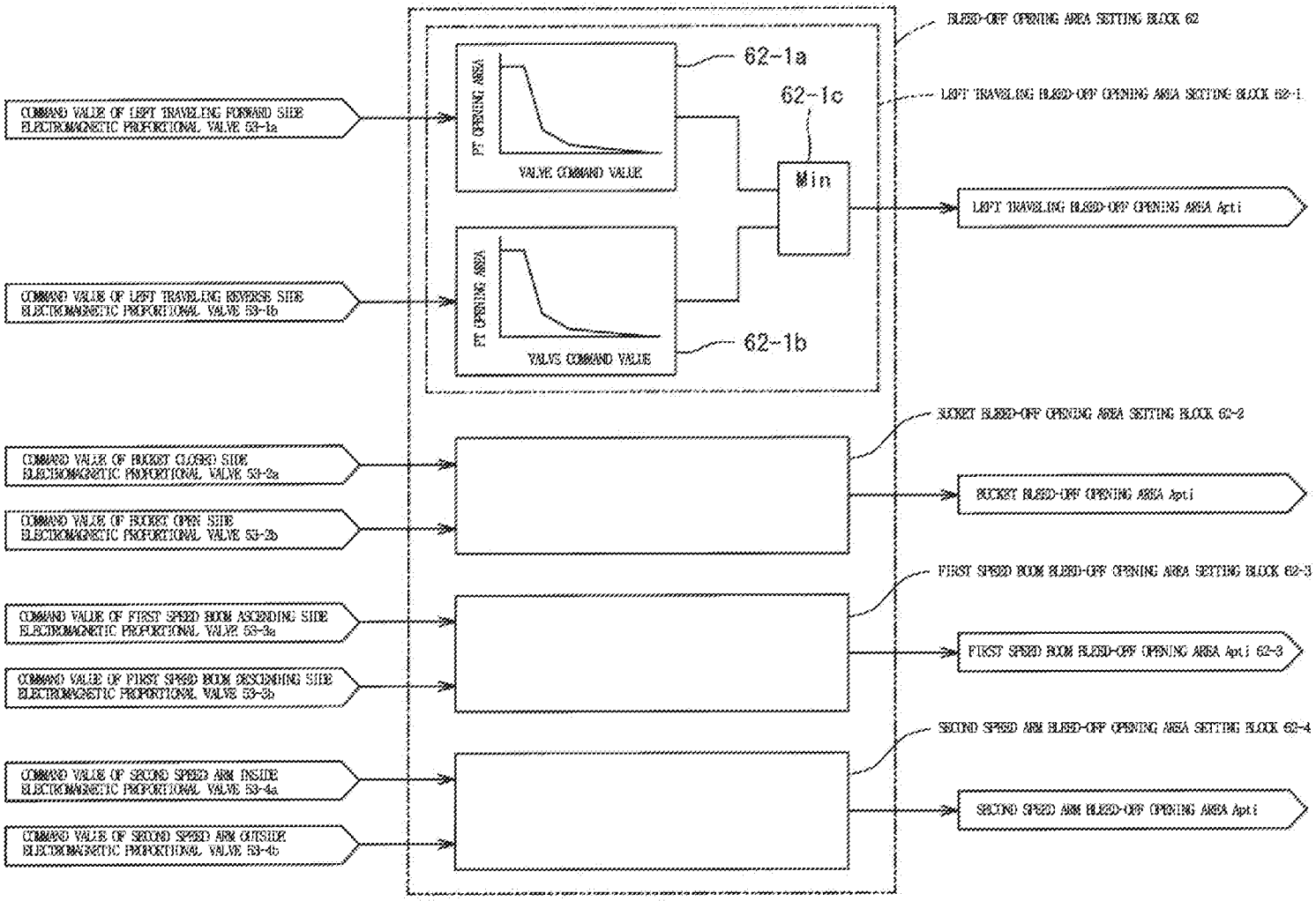

[Fig 10]
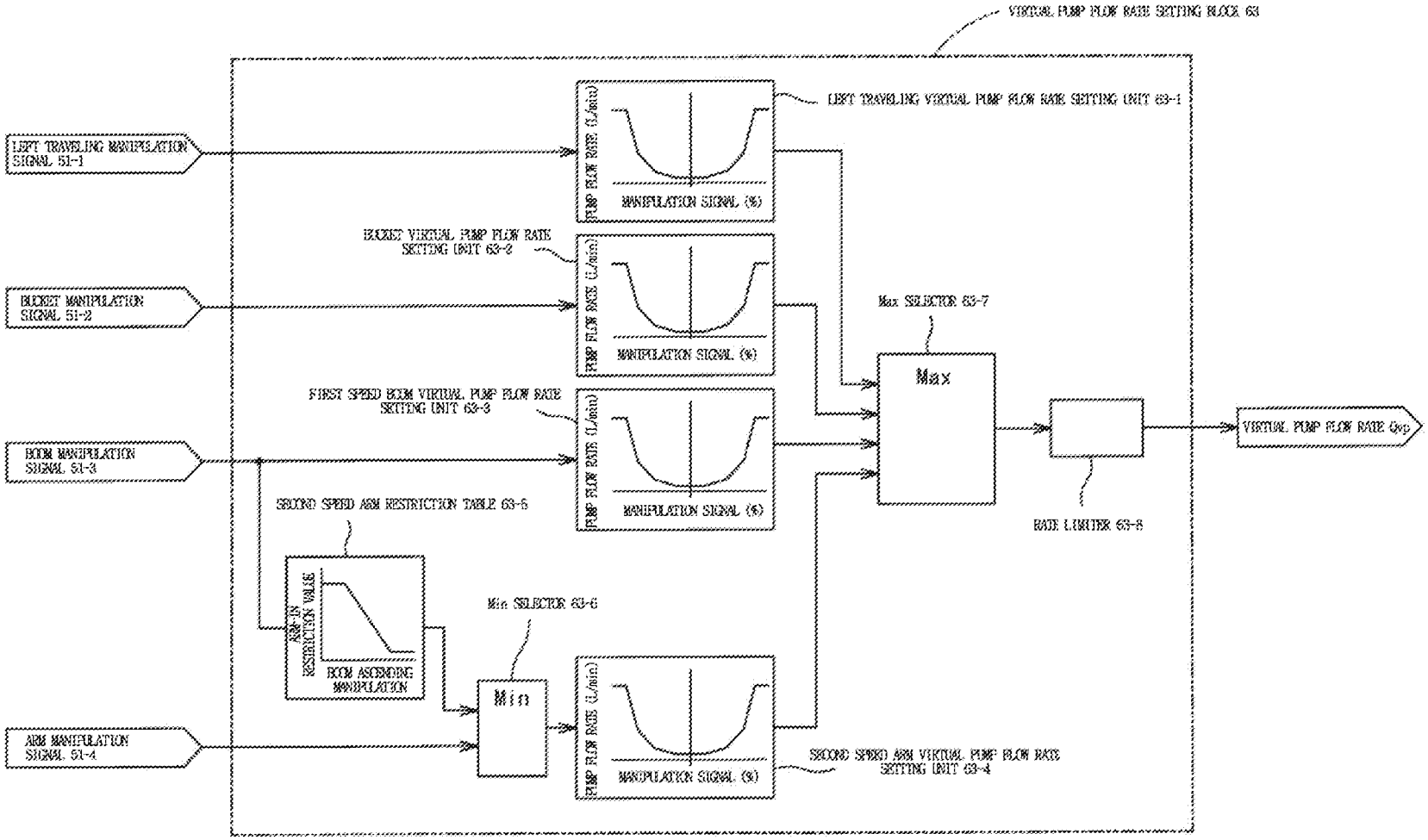

[Fig 11]
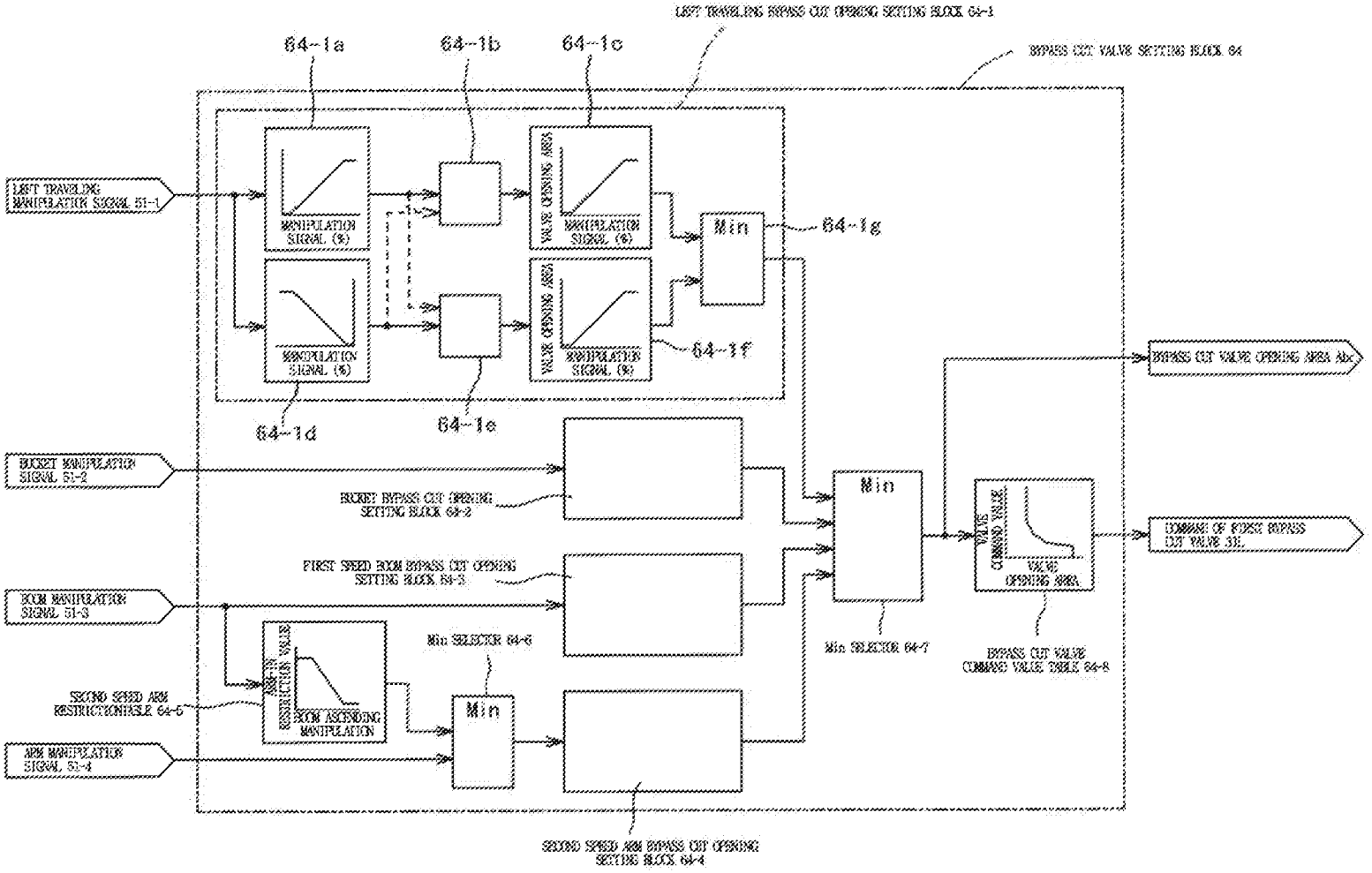

[Fig 12]
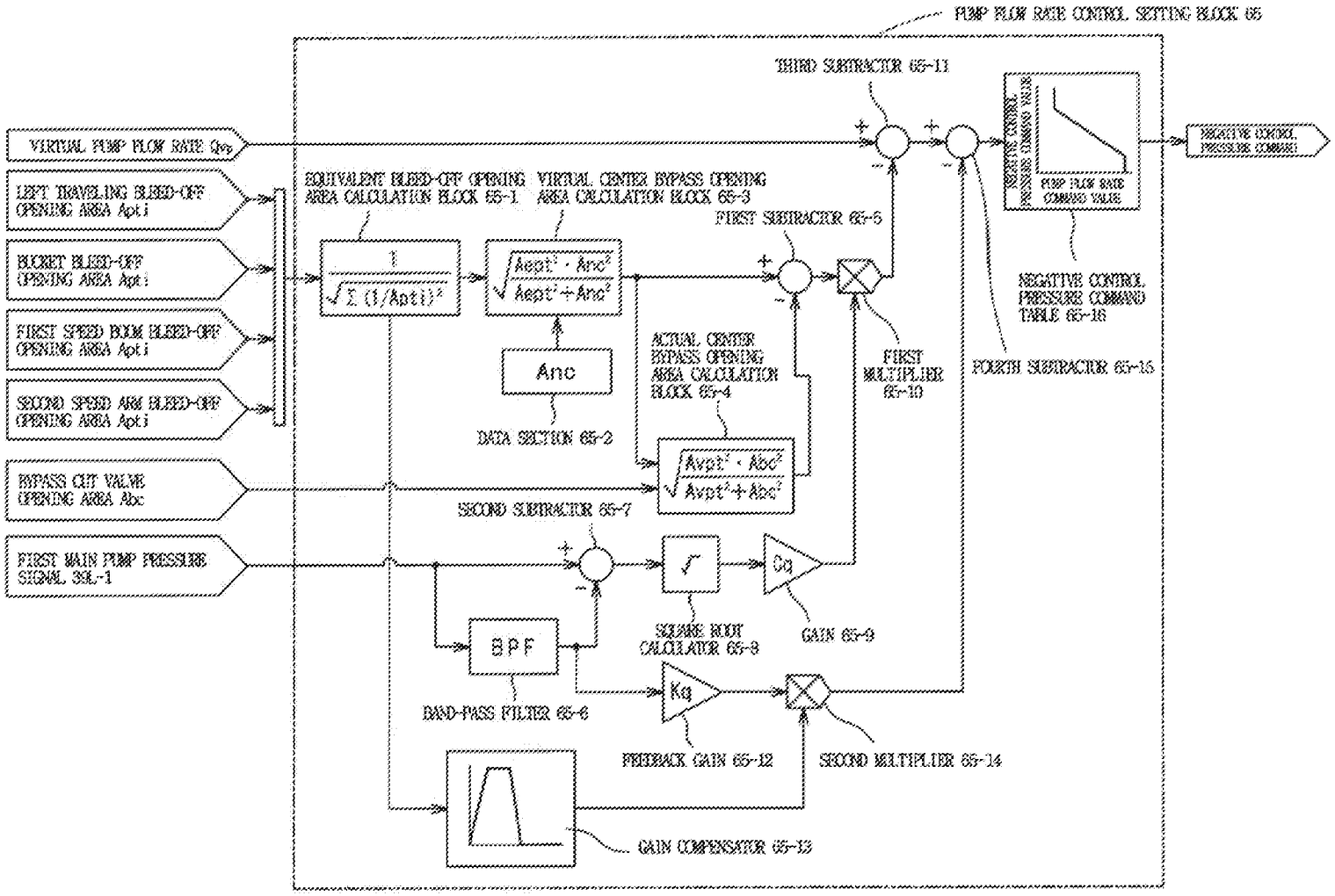

[Fig 13]
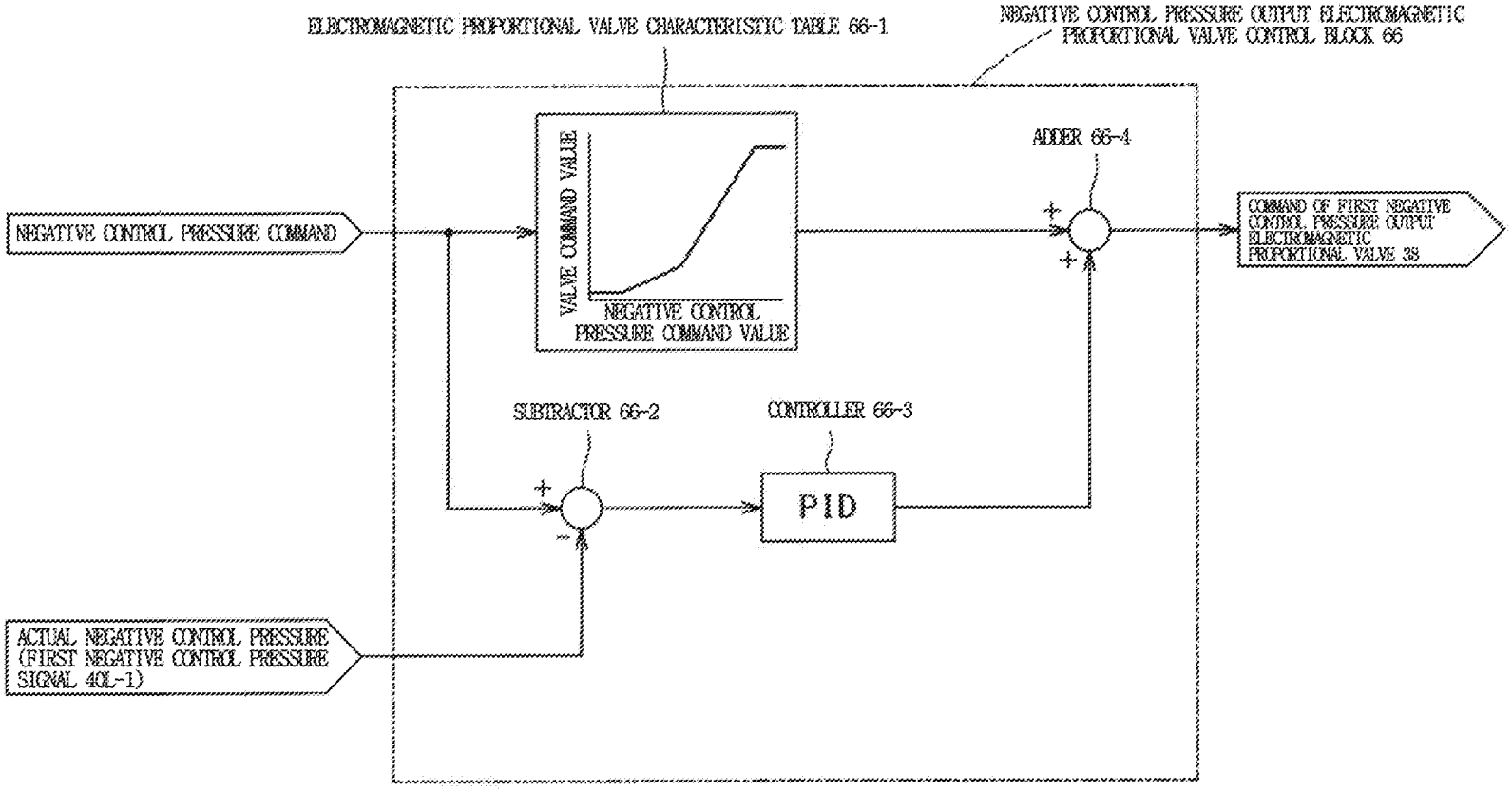

[Fig 14]
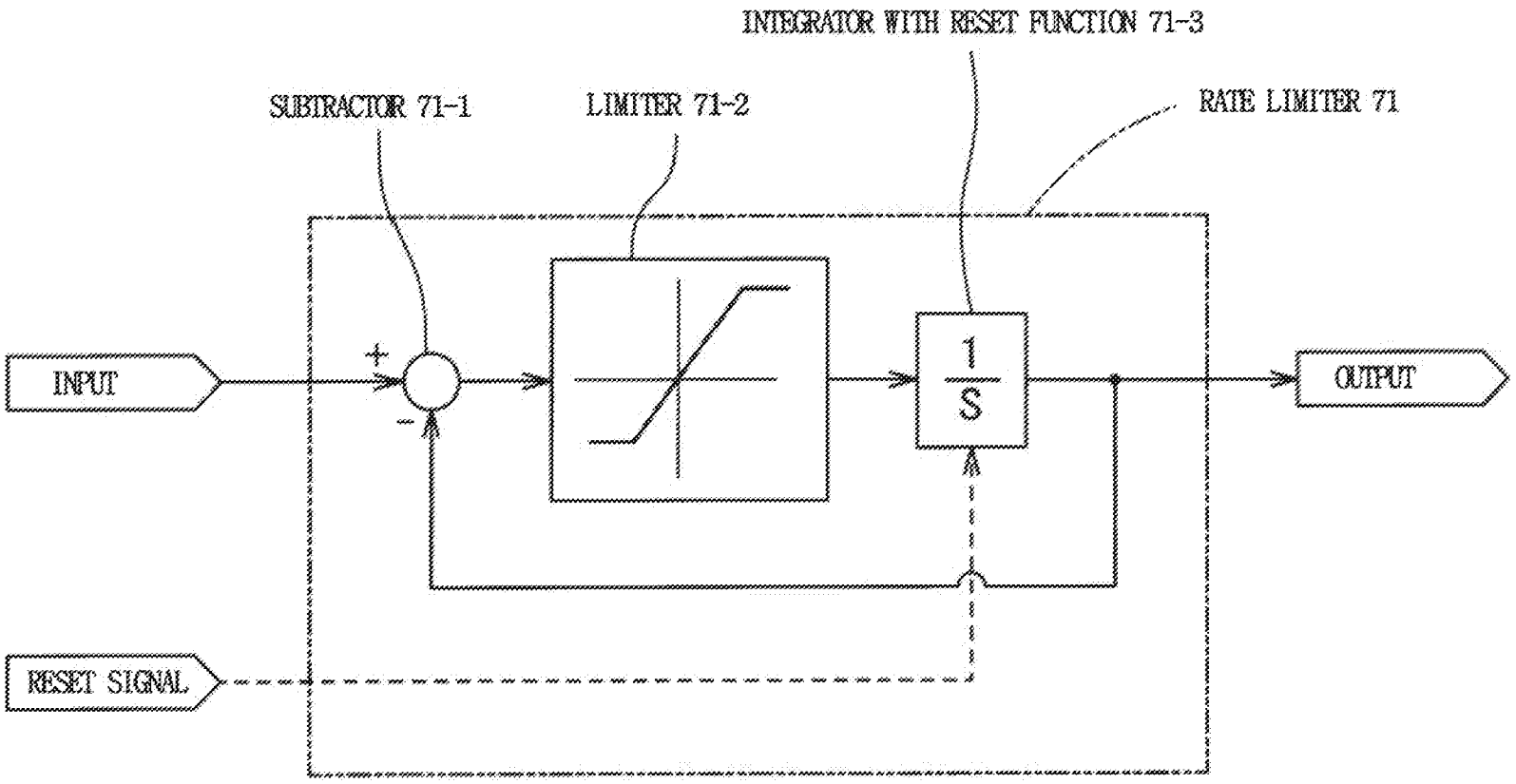

[Fig. 15]
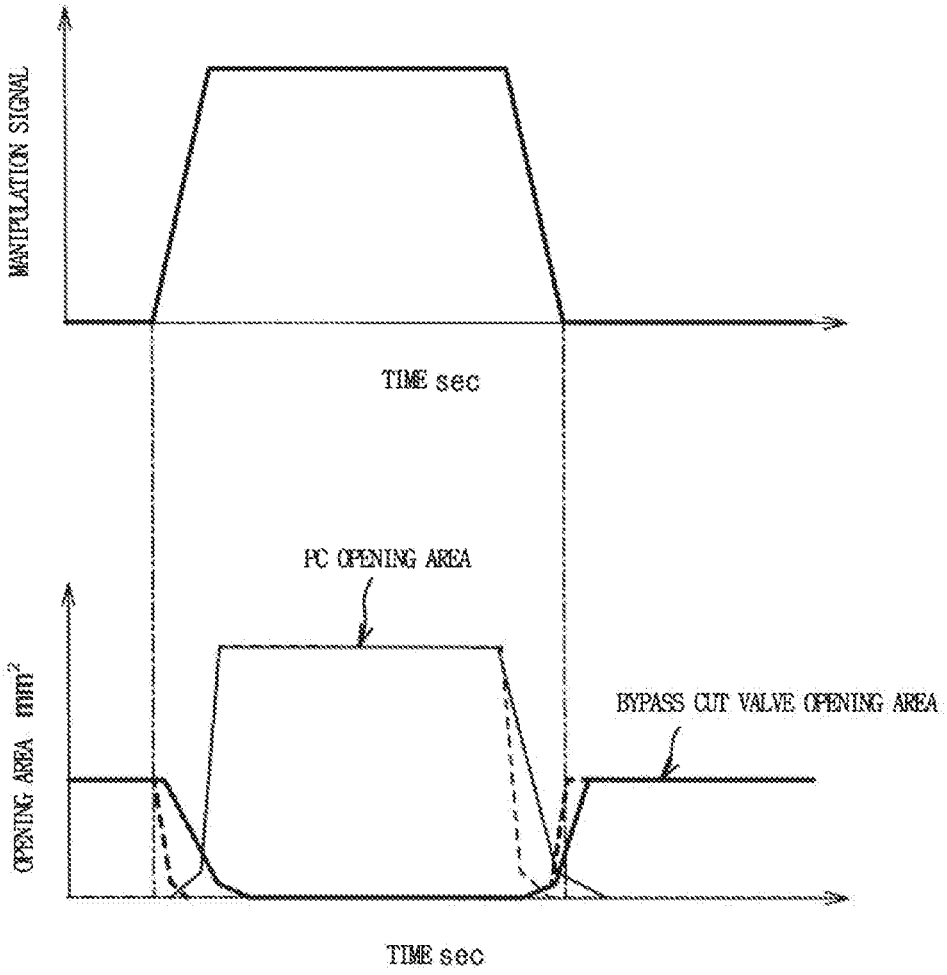

[Fig. 16A]
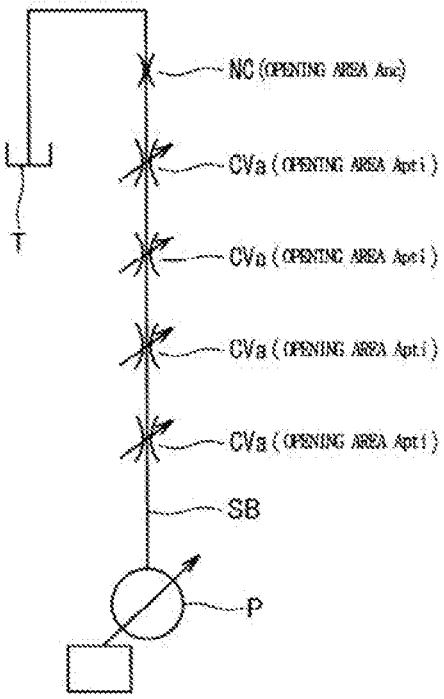
[Fig. 16B]
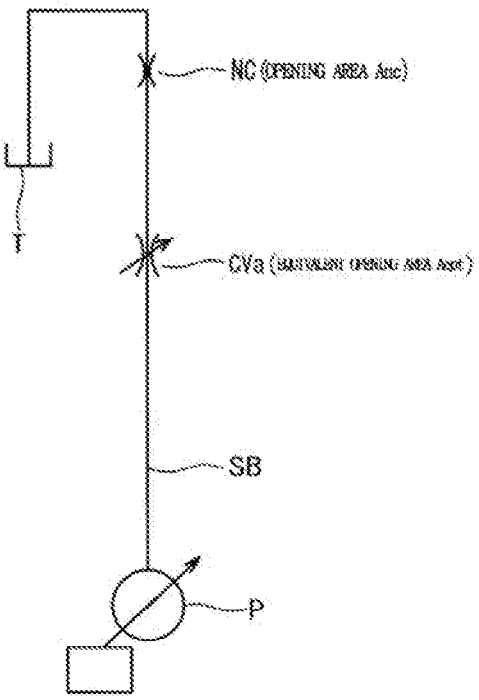

[Fig. 17]
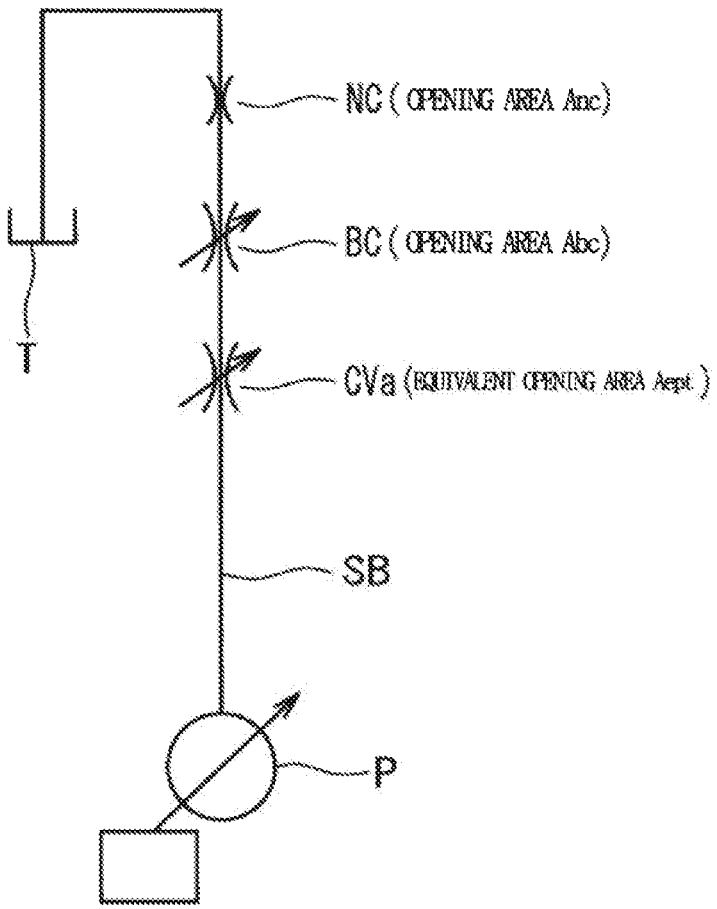

[Fig. 18]
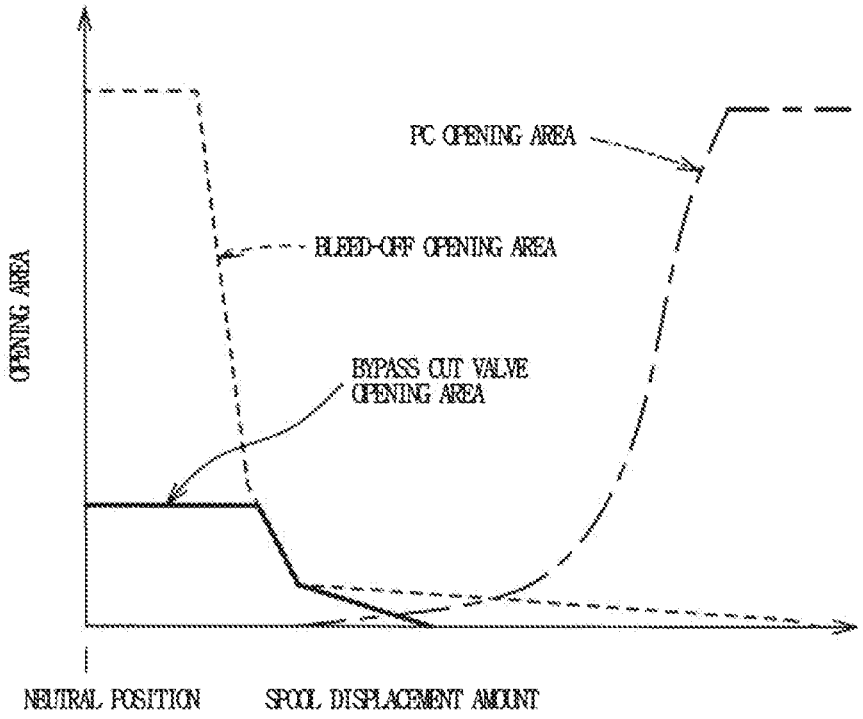

[Fig. 19]
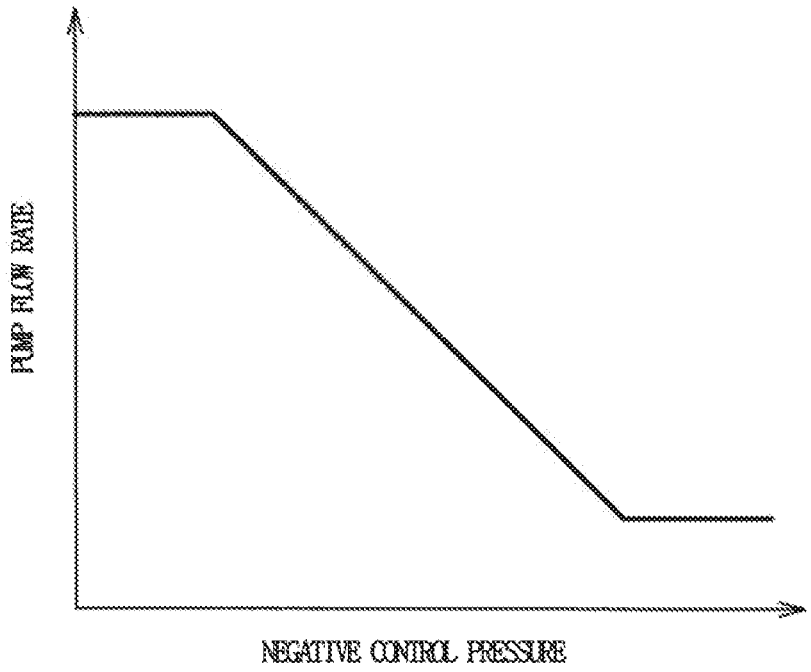

[Fig. 20]
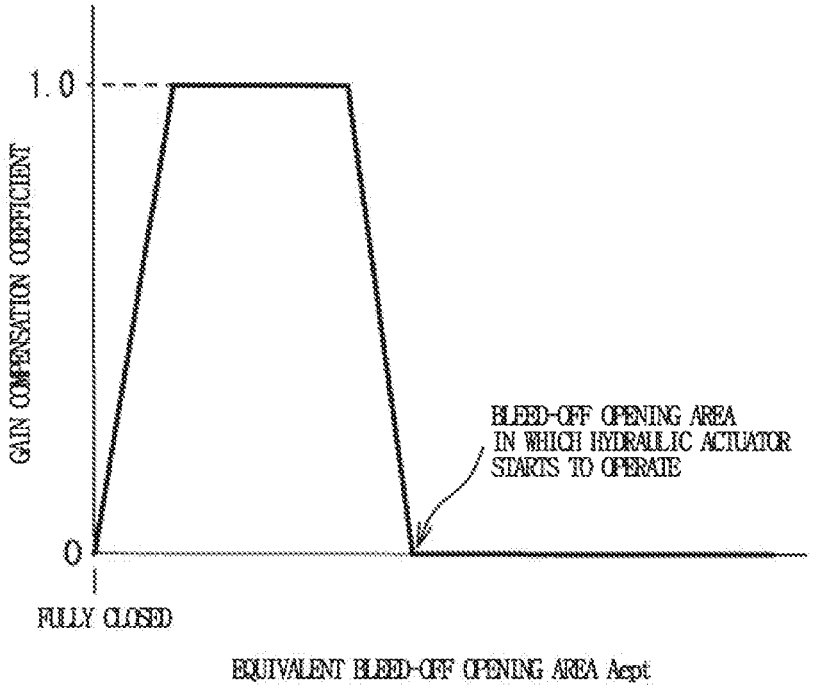

HYDRAULIC PUMP CONTROL SYSTEM OF HYDRAULIC WORKING MACHINE

CROSS-REFERENCE TO RELATED APPLICATION

This Application is a 35 USC § 371 US National Stage filing of International Application No. PCT/EP2016/072076 filed on Sep. 16, 2016 which claims priority under the Paris Convention to Japanese Serial No. 2015-183162 filed on Sep. 16, 2015, and claiming priority to Japanese Serial No. 2015-183163 filed on Sep. 16, 2015.

TECHNICAL FIELD

The present invention relates to a technical field of a hydraulic pump control system of a hydraulic working machine such as a hydraulic shovel.

BACKGROUND ART

In general, in a hydraulic circuit provided in a hydraulic working machine such as a hydraulic shovel, an open center control system is widely known in the related art. An open center control system is equipped with a variable displacement hydraulic pump, an open center type flow rate control valve configured to control a supply flow rate to a hydraulic actuator from the hydraulic pump, a center bypass oil passage extending from the hydraulic pump to the oil tank via a bleed-off opening of the flow rate control valve. A negative control throttle is disposed on the center bypass oil passage on the downstream side of the bleed-off opening to generate a negative control pressure, and is configured to perform increase and decrease control of the pump flow rate of the hydraulic pump in accordance with the negative control pressure.

However, in the open center control system configured to control the pump flow rate by the negative control pressure using the open center type flow rate control valve, there was a problem in that energy saving was impeded by the large bleed-off flow rate flowing from the center bypass oil passage to the oil tank.

Therefore, a technique of controlling the pump flow rate according to a virtual negative control pressure calculated by a controller has been proposed in Japanese Unexamined Patent Application Publication No. 2013-148174. The bleed-off flow rate is reduced by reducing the bleed-off opening area formed in the flow rate control valve while providing no negative control throttle in the center bypass oil passage.

However, the system disclosed in the '174 publication is configured to perform a flow control of the hydraulic pump by calculating a virtual negative control pressure based on a manipulation amount of a hydraulic actuator manipulation tool (such as an operator lever or pedal) and a discharge pressure of the hydraulic pump, and by outputting the virtual negative control pressure using an electromagnetic proportional valve. Therefore, when there is a failure of a pressure sensor configured to detect the pump discharge pressure or the electromagnetic proportional valve, there is a problem that it is not possible to control the pump flow rate and operate the hydraulic actuator. Further, the flow rate control valve used in the '174 publication is a special flow rate control valve having a small bleed-off opening area. If an existing system using the conventional open center type flow rate control valve is changed to the published control system in order to reduce the bleed-off flow rate, there is a problem of increase in cost since special flow rate control valves at least equal in number to the hydraulic actuators need to be prepared.

Additionally, the bleed-off opening area of the flow rate control valve in the '174 publication is set to be considerably smaller than the bleed-off opening area of a conventional open center type flow rate control valve. Thus, it is expected that the bleed-off flow rate decreases and damping of the hydraulic system gets worse. Also, since the virtual negative control pressure and the virtual bleed-off flow rate are calculated using the pump discharge pressure detected by a pressure sensor, there is also a problem that hunting is likely to occur. Furthermore, the bleed-off opening area is considerably narrowed when the manipulation amount of the hydraulic actuator manipulation tool is small, that is, when the hydraulic actuator supply opening of the flow rate control valve is open only a little. Accordingly, when the manipulation tool is operated in phases or when a reversing operation of suddenly switching the manipulation tool in an opposite direction is performed, because the bleed-off opening area to bleed off the pump flow is too narrow, there is a problem that the pump pressure rapidly increases and operability deteriorates. The present invention seeks to solve one or more of these problems.

SUMMARY OF INVENTION

According to a first aspect of the invention, there is provided a hydraulic pump control system of a hydraulic working machine including a variable displacement hydraulic pump having a variable displacement means for varying the hydraulic pump displacement; a hydraulic actuator to which a pressure oil is supplied from the hydraulic pump; an open center type flow rate control valve that has a bleed-off opening configured to allow a pump flow rate to flow to an oil tank at a neutral position, and controls the supply flow rate from the hydraulic pump to the hydraulic actuator based on the manipulation of a hydraulic actuator manipulation tool; a center bypass oil passage that extends from the hydraulic pump to the oil tank via the bleed-off opening of the flow rate control valve; and a negative control throttle that is disposed in the center bypass oil passage on the downstream side of the bleed-off opening to generate the negative control pressure. The hydraulic pump control system includes a bypass cut valve that is disposed on the upstream side of the negative control throttle to close the center bypass oil passage when operated; a negative control pressure output valve that is operated to output a virtual negative control pressure; control means that controls the operation of the bypass cut valve and the negative control pressure output valve; and a negative control pressure introduction means that selectively guides one of the negative control pressure generated by the negative control throttle and the virtual negative control pressure that is output from the negative control pressure output valve to the variable displacement means of the hydraulic pump.

According to a second aspect, the control means performs a virtual bleed-off control which operates the bypass cut valve based on the manipulation of the hydraulic actuator manipulation tool to reduce the bleed-off flow rate flowing to the oil tank from the center bypass oil passage. The control means determines a bleed-off reduction flow rate based upon a difference between a virtual bleed-off flow rate obtained on the assumption the bypass cut valve is not present and an actual bleed-off flow rate determined when the bypass cut valve is operated. The control means determines a pump request flow rate by subtracting the bleed-off reduction flow rate from a virtual pump flow rate obtained determined in an open center control mode, and operates the negative control pressure output valve to produce the virtual negative control pressure corresponding to the pump request flow rate.

According to a third aspect of the invention based upon the second aspect, the control means sets the virtual pump flow rate in accordance with a manipulation amount of the hydraulic actuator manipulation tool, using a function table between a manipulation signal of the hydraulic actuator manipulation tool and the pump flow rate of the hydraulic pump. The function table is created in advance with the bypass cut valve and negative control pressure output valve not operated, based on a detected value of the negative control pressure generated by the negative control throttle when changing the manipulation signal of the hydraulic actuator manipulation tool, using known pump flow rate characteristics at a given negative control pressure.

According to a fourth aspect of the invention incorporating the second or third aspects, the control means calculates the bleed-off reduction flow rate based on the product of a change in the bleed-off opening area of the center bypass passage caused by the bypass cut valve and a filtered hydraulic pump pressure. A frequency component of a hydraulic system natural frequency is extracted using a band-pass filter from the pump pressure signal generated by a pressure detecting means for detecting the discharge pressure of the hydraulic pump. A pressure obtained by subtracting the extracted frequency component from the pump pressure is used as a filtered hydraulic pump pressure.

According to a fifth aspect of the invention incorporating the fourth aspect, the control means performs a pressure feedback of the frequency component extracted by the band-pass filtering process, when determining the pump request flow rate.

According to a sixth aspect of the invention incorporating any of the first five aspects, the control means performs a rate limiter process for adjusting opening and closing timings of a hydraulic actuator pressure oil supply opening provided in the flow rate control valve and the opening of the bypass cut valve. When opening the hydraulic actuator pressure oil supply opening, the control means operates the bypass cut valve to be slower than the flow rate control valve, and when closing the hydraulic actuator pressure oil supply opening, the control means operates the bypass cut valve to be faster than the flow rate control valve.

According to a seventh aspect of the invention incorporating any of the first six aspects, the control means feeds back the actual negative control pressure detected by a pressure detecting means for detecting an output pressure of the negative control pressure output valve, when controlling the negative control pressure output valve.

According to the first aspect of the invention, it is possible to reduce the bleed-off flow rate and the discharge flow rate of the hydraulic pump which can contribute to energy saving. Moreover, it is possible to operate the hydraulic actuator equally with the conventional open center control system even in a virtual bleed-off control mode. Furthermore, in the state in which the bypass cut valve and the negative control pressure output valve are not operated, the negative control pressure generated by the negative control throttle is guided to the variable displacement means of the hydraulic pump. Thus, even when the bypass cut valve or the negative control pressure output valve break down, it is possible to perform pump flow rate control of the hydraulic pump using the negative control pressure generated by the negative control throttle. In addition, the change from the existing open center control system is also easy, which can significantly contribute to cost suppression.

According to the third aspect of the invention, it is possible to more reliably set the operation of the hydraulic actuator in the virtual bleed-off control to be equivalent to conventional open center control.

According to the fourth aspect of the invention, it is possible to suppress the frequency variation of the calculated bleed-off reduction flow rate, in order to prevent hunting of the pump pressure.

According to the fifth aspect of the invention, the damping coefficient of the hydraulic system increases, which can contribute to the suppression of hunting.

According to the sixth aspect of the invention, since pump pressure rises smoothly, operability is improved, and when the hydraulic actuator manipulation tool is operated in stages or when a reversing operation of suddenly switching the hydraulic actuator manipulation tool in the opposite direction is performed, it is possible to avoid the problem that the discharge oil of the hydraulic pump is confined and the pump pressure rapidly rises.

According to the seventh aspect of the invention, it is possible to reduce the hysteresis of the negative control pressure output valve and to improve the responsiveness and controllability.

BRIEF DESCRIPTION OF DRAWINGS

FIG. 1 is a side view of a hydraulic shovel.

FIG. 2 is a hydraulic circuit diagram of the hydraulic shovel.

FIG. 3 is a block diagram illustrating input and output of a controller.

FIG. 4 is a flow chart of a main routine.

FIG. 5 is a flow chart of open center control.

FIG. 6 is a flow chart diagram of table creation control for setting a virtual pump flow rate.

FIG. 7 is a block diagram illustrating a configuration of a pump and valve control block.

FIG. 8 is a block diagram illustrating a configuration of a flow rate control valve control block.

FIG. 9 is a block diagram illustrating a configuration of a bleed-off opening area setting block.

FIG. 10 is a block diagram illustrating a configuration of a virtual pump flow rate setting block.

FIG. 11 is a block diagram illustrating a configuration of a bypass cut valve setting block.

FIG. 12 is a block diagram illustrating a configuration of a pump flow rate control block.

FIG. 13 is a block diagram illustrating a configuration of a negative control pressure output electromagnetic proportional valve control block.

FIG. 14 is a block diagram illustrating a configuration of a rate limiter.

FIG. 15 is a diagram illustrating opening and closing timings of a flow rate control valve and a bypass cut valve.

FIGS. 16A and 16B are model diagrams of the center bypass oil passage in the open center control system.

FIG. 17 is a model diagram of the center bypass oil passage in the virtual bleed-off control system.

FIG. 18 is an opening characteristic diagram of the flow rate control valve and the bypass cut valve.

FIG. 19 is a characteristic diagram of the pump flow rate and the negative control pressure.

FIG. 20 is a diagram illustrating the characteristics of a gain compensator.

DETAILED DESCRIPTION

Hereinafter, an embodiment of the present invention will be described with reference to the accompanying drawings. FIG. 1 is a diagram illustrating a hydraulic shovel 1 which is an example of a hydraulic working machine of the present invention. The hydraulic shovel 1 is configured with an upper turning body 3 turnably supported above a crawler type lower traveling body 2, and a front working portion 7 including a boom 4, an arm 5 and a bucket 6 mounted on the upper turning body 3. Further, the hydraulic shovel 1 is configured to include left and right traveling motors 8L and 8R which drive the lower traveling body 2, a turning motor 9 which drives the upper turning body 3, and various hydraulic actuators such as a boom cylinder 10, an arm cylinder 11 and a bucket cylinder 12 which move the boom 4, the arm 5 and the bucket 6, respectively.

FIG. 2 is a diagram illustrating a hydraulic circuit provided in the hydraulic shovel 1, and a hydraulic pump control system of the present invention is provided in the hydraulic circuit. In FIG. 2, corresponding reference numerals denote each of the left and right traveling motors 8L and 8R, the turning motor 9, the boom cylinder 10, the arm cylinder 11 and the bucket cylinder 12, collectively referred to as hydraulic actuators A of the present invention. Corresponding reference numerals designate variable displacement first and second main pumps 13 and 14 serving as a hydraulic supply source of the hydraulic actuators A, which are swash plate type variable displacement piston pumps according to the present embodiment described herein. Reference numerals 13*a* and 14*a* denote swash plate controls of the first and second main pumps 13 and 14, reference numeral 15 denotes a pilot pump serving as a pilot hydraulic source, and reference numeral 16 denotes an oil tank. Further, reference numeral 17 denotes an engine which drives the first and second main pumps 13 and 14 and the pilot pump 15.

In FIG. 2, reference numerals 18 and 19 denote first and second discharge lines to which the discharge oil of the first and second main pumps 13 and 14 is supplied. Each of a left traveling flow rate control valve 20, a bucket flow rate control valve 21, a first speed boom flow rate control valve 22, and a second speed arm flow rate control valve 23 is connected to the first discharge line 18. Each of a right traveling flow rate control valve 24, a turning flow rate control valve 25, a first speed arm flow rate control valve 26, and a second speed boom flow rate control valve 27 is connected to the second discharge line 19.

The left traveling flow rate control valve 20 and the right traveling flow rate control valve 24 are valves which control the supply flow rates to the left traveling motor 8L and the right traveling motor 8R, respectively, from the first and second main pumps 13 and 14, and the discharge flow rate from the left traveling motor 8L and the right traveling motor 8R to the oil tank 16, based on forward side and reverse side manipulation of the left and right traveling manipulation tools. The left traveling flow rate control valve 20 and the right traveling flow rate control valve 24 also have a function of a direction control valve which switches the flow direction of the oil.

Further, the bucket flow rate control valve 21 is a valve which controls the supply flow rate from the first main pump 13 to the bucket cylinder 12 and the discharge flow rate from the bucket cylinder 12 to the oil tank 16, based on the closed side and open side of the bucket manipulation tool, and also has a function of the direction control valve which switches the flow direction of the oil.

The turning flow rate control valve 25 is a valve which controls the supply flow rate from the second main pump 14 to the turning motor 9 and the discharge flow rate from the turning motor 9 to the oil tank 16, based on the left turning side and right turning side manipulations of the turning manipulation tool, and also has a function of the direction control valve which switches the flow direction of the oil.

The first speed boom flow rate control valve 22 controls the supply flow rate from the first main pump 13 to the boom cylinder 10 and the discharge flow rate from the boom cylinder 10 to the oil tank 16, based on the ascending side and descending side manipulations of the boom control tool, and also has a function of a direction control valve which switches the flow direction of the oil. The second speed boom flow rate control valve 27 controls the supply flow rate from the second main pump 14 to the boom cylinder 10, based on the ascending side manipulation of the boom manipulation tool.

The first speed arm flow rate control valve 26 controls the supply flow rate from the second main pump 14 to the arm cylinder 11 and the discharge flow rate from the arm cylinder 11 to the oil tank 16, based on in and out manipulations of the arm manipulation tool, and also has a function of a direction control valve which switches the flow direction of the oil. The second speed arm flow rate control valve 23 controls the supply flow rate from the first main pump 13 to the arm cylinder 11 and the discharge flow rate from the arm cylinder 11 to the oil tank 16, based on the in and out manipulations of the arm manipulation tool, and also has a function of a direction control valve which switches the flow direction of the oil.

Although it is not illustrated, the left and right traveling manipulation tools, the bucket manipulation tool, the turning manipulation tool, the boom manipulation tool and the arm manipulation tool are an operation lever or an operation pedal, which may also be referred to as a hydraulic actuator manipulation tool or simply a manipulation tool in the following description and correspond to the hydraulic actuator manipulation tool of the present invention.

All of the left traveling flow rate control valve 20, the bucket flow rate control valve 21, the first speed boom flow rate control valve 22, the second speed arm flow rate control valve 23, the right traveling flow rate control valve 24, the turning flow rate control valve 25, the first speed arm flow rate control valve 26, and the second speed boom flow rate control valve 27 are pilot-operated spool valves which are switched from a pilot pressure that is output from the corresponding pilot pressure output electromagnetic proportional valve 53 based on the manipulation of the manipulation tool. Although the pilot pressure output electromagnetic proportional valve 53 is not illustrated in FIG. 2, it is illustrated as a pilot valve block 28 in which a plurality of pilot pressure output electromagnetic proportional valves 53 are integrated. In a state in which the pilot pressure is not supplied, the pilot-operated spool valve is located at a neutral position at which the supply of pressure oil to the hydraulic actuator A is not performed. However, when the pilot pressure is supplied, the spool is displaced and the pilot-operated spool valve is switched to the operating position at which the pressure oil supply control on the hydraulic actuator A is performed to open a pressure oil supply opening (hereinafter referred to as a PC opening) from the first and second main pumps 13 and 14 to the corresponding hydraulic actuator A, and an oil discharge opening (hereinafter referred to as a CT opening) from the hydraulic actuator A to the oil tank. The opening areas of the PC opening and the CT opening change in accordance with the spool displacement amount, and thus the supply flow rate control from the first and second main pumps 13 and 14 to the hydraulic actuator A, and the discharge flow rate control from the hydraulic actuator A to the oil tank 16 are performed. Further, the pilot pressure output electromagnetic proportional valve 53 which outputs the pilot pressure to the flow rate control valves 20 to 27 is controlled by a controller 50 to be described below, and its control will be described below.

Each of the flow rate control valves 20 to 27 is an open center type valve, and has bleed-off openings (PT openings) 20*a* to 27*a* for allowing the discharge oil of the first and second main pumps 13 and 14 to flow to the oil tank 16. The opening areas of the bleed-off openings 20*a* to 27*a* are set so that the opening areas are largest at the neutral position and the opening areas decrease with an increase in the spool displacement amount, as illustrated in FIG. 18. In the following description, in some cases, the left traveling flow rate control valve 20, the bucket flow rate control valve 21, the first speed boom flow rate control valve 22, the second speed arm flow rate control valve 23, the right traveling flow rate control valve 24, the turning flow rate control valve 25, the first speed arm flow rate control valve 26, and the second speed boom flow rate control valve 27 are referred to as a flow rate control valve CV, and each of the bleed-off openings 20*a* to 27*a* of each of the flow rate control valves 20 to 27 is also referred to as a bleed-off opening $CV_a$.

In FIG. 2, reference numerals 29 and 30 denote first and second center bypass oil passages. The first center bypass oil passage 29 is formed to extend from the first discharge line 18 in series through the bleed-off openings 20*a* to 23*a* of each of the left traveling flow rate control valve 20, the bucket flow rate control valve 21, the first speed boom flow rate control valve 22, and the second speed arm flow rate control valve 23 to the oil tank 16. Further, the second center bypass oil passage 30 is formed to extend from the second discharge line 19 in series through each of the right traveling flow rate control valve 24, the turning flow rate control valve 25, the first speed arm flow rate control valve 26, and the second speed boom flow rate control valve 27 to the oil tank 16.

In the first and second center bypass oil passages 29 and 30, each of the first and second bypass cut valves 31L and 31R is provided downstream from the downstream from the second speed arm flow rate control valve 23 in the first center bypass oil passage 29, and the second speed boom flow rate control valve 27 in the second center bypass oil passage 30, respectively. The first and second negative control throttles 32L and 32R and the first and second negative control relief valves 33L and 33R are disposed further downstream from the first and second bypass cut valves 31L and 31R, respectively.

The first and second bypass cut valves 31L and 31R are electromagnetic valves which open and close the first and second center bypass oil passages 29 and 30 upstream from of the first and second negative control throttles 32L and 32R, and are switched into an operating position X at which the first and second center bypass oil passages 29 and 30 are variably closed from a fully opened position N (non-operating state) in which the first and second center bypass oil passages 29 and 30 are fully open, based on the control command from a controller 50 to be described later. The opening area of the operating position X is controlled to increase or decrease by the controller 50.

The first and second negative control throttles 32L and 32R generate a control pressure (negative control pressure) upstream from the first and second negative control throttles 32L and 32R, by throttling the pressure oil flowing through the first and second center bypass oil passages 29 and 30, when the first and second bypass cut valves 31L and 31R are fully open (in the non-operating state). The negative control pressure generated upstream from the first and second negative control throttles 31L and 32L is input to one of input ports 35La and 35Ra of the first and second shuttle valves 35L and 35R to be described later via the first and second negative control lines 34L and 34R.

First and second negative control relief valves 33L and 33R are disposed in parallel with the first and second negative control throttles 32L and 32R, and are configured to release the pressure oil of the first and second center bypass oil passages 29 and 30 to the oil tank 16 when the pressure of the first and second center bypass oil passages 29 and 30 upstream from the first and second negative control throttles 32L and 32R exceeds a predetermined relief pressure.

Further, the left traveling flow rate control valve 20, the bucket flow rate control valve 21, the first speed boom flow rate control valve 22, the second speed arm flow rate control valve 23, the right traveling flow rate control valve 24, the turning flow rate control valve 25, the first speed arm flow rate control valve 26, the second speed boom flow rate control valve 27, the first and second bypass cut valves 31L and 31R, the first and second negative control throttles 32L and 32R, and the first and second negative control relief valves 33L and 33R are assembled into a unit as the control valve 37.

In FIG. 2, reference numerals 38L and 38R denote first and second negative control pressure output electromagnetic proportional valves (corresponding to the negative control pressure output valves of the present invention). The first and second negative control pressure output electromagnetic proportional valves 38L and 38R are configured to output a negative control pressure based on a control command from the controller 50 in the virtual bleed-off control to be described later, and the output pressure is input to the other of the input ports 35Lb and 35Rb of the first and second shuttle valves 35L and 35R.

Further, the first and second shuttle valves 35L and 35R select the high pressure side, among the pressure of the first and second negative control lines 34L and 34R that are input from one of the input ports 35La and 35Ra, and the output pressure of the first and second negative control pressure output electromagnetic proportional valves 38L and 38R that are input from the other of the input ports 35Lb and 35Rb, and output the selected pressure as the pump control negative control pressure to the variable displacement means 13*a* and 14*a*, corresponding to swash plate angle control actuators in the present embodiment, of the first and second main pumps 13 and 14. The variable displacement means 13*a* and 14*a* are configured to perform the negative control of reducing the pump flow rate with an increase in the negative control pressure, as illustrated in the characteristic diagrams of the pump flow rate and the negative control pressure of FIG. 19. Further, the first and second shuttle valves 35L and 35R correspond to the negative control pressure introducing means of the present invention.

In FIG. 2, reference numerals 39L and 39R denote first and second pump pressure sensors (corresponding to the pressure detecting means for detecting the discharge pressure of the hydraulic pump of the present invention) which detect the discharge pressure of the first and second main pumps 13 and 14. Reference numerals 40L and 40R denote first and second negative control pressure sensors (corresponding to a pressure detecting means for detecting the output pressure of the negative control output valve of the present invention) which detect the pump control negative control pressure that is output from the first and second shuttle valves 35L and 35R, and the detection signals that are output from the sensors 39L, 39R, 40L and 40R are input to the controller 50.

In FIG. 2, reference numeral 41 denotes a back pressure check valve provided in the return circuit, and reference numeral 42 denotes an oil cooler. Further, reference numeral 43 denotes a straight-travel valve configured to be switched to the operating position X from the neutral position N to secure the straight-traveling when the left and right traveling manipulation tools and other hydraulic actuator manipulation tools are simultaneously operated. However, in the present embodiment, in a state in which the straight-travel valve 43 is located at the neutral position N, the discharge oil of the first main pump 13 is supplied to the left traveling flow rate control valve 20, the bucket flow rate control valve 21, the first speed boom flow rate control valve 22 and the second speed arm flow rate control valve 23, and the discharge oil of the second main pump 14 is supplied to the right traveling flow rate control valve 24, the turning flow rate control valve 25, the first speed arm flow rate control valve 26, and the second speed boom flow rate control valve 27. Further, in FIG. 2, reference numeral 44 denotes a boom regeneration valve, reference numeral 45 denotes a variable turning priority valve, reference numeral 46 denotes an arm regeneration valve, and reference numeral 47 denotes a main relief valve connected to the first and second discharge lines 18 and 19.

The control means of the present invention is illustrated in the block diagram of FIG. 3, including a controller 50, a manipulation detecting means 51 for detecting each of the manipulation direction and the manipulation amount of each hydraulic actuator manipulation tool (left and right traveling manipulation tools, a bucket manipulation tool, a turning manipulation tool, a boom manipulation tool, and an arm manipulation tool), the first and second pump pressure sensors 39L and 39R, the first and second negative control pressure sensors 40L and 40R, a mode switch 52 to be described later and the like are connected to an input side of the controller 50. Meanwhile, a pilot pressure output electromagnetic proportional valve 53 (a left traveling forward side electromagnetic proportional valve 53-1*a*, a left traveling reverse side electromagnetic proportional valve 53-1*b*, a bucket closed side electromagnetic proportional valve 53-2*a*, a bucket open side electromagnetic proportional valve 53-2*b*, a first speed boom ascending side electromagnetic proportional valve 53-3*a*, a first speed boom descending side electromagnetic proportional valve 53-3*b*, a second speed arm inside electromagnetic proportional valve 53-4*a*, a second speed arm outside electromagnetic proportional valve 53-4*b*, a right traveling forward side electromagnetic proportional valve 53-5*a*, a right traveling reverse side electromagnetic proportional valve 53-5*b*, a left turning side electromagnetic proportional valve 53-6*a*, a right turning side electromagnetic proportional valve 53-6*b*, a first speed arm inside electromagnetic proportional valve 53-7*a*, a first speed arm outside electromagnetic proportional valve 53-7*b*, and a second speed boom ascending side electromagnetic proportional valve 53-8*a*) which outputs the pilot pressure to each of the left traveling flow rate control valve 20, the bucket flow rate control valve 21, the first speed boom flow rate control valve 22, the second speed arm flow rate control valve 23, the right traveling flow rate control valve 24, the turning flow rate control valve 25, the first speed arm flow rate control valve 26 and the second speed boom flow rate control valve 27, the first and second bypass cut valves 31L and 31R, the first and second negative control pressure output electromagnetic proportional valves 38L and 38R and the like are connected to an output side of the controller 50, and these valves are connected to a monitor device 54 disposed in a cab of the hydraulic shovel 1 to be able to perform mutual input and output.

Here, the monitor device 54 includes a display 54*a* which displays various kinds of information such as device information and camera information, and includes a manipulation means 54*b* (a touch panel, a manipulation key, etc.) for performing screen switching, various settings, memory rewriting or the like of the controller 50.

Mode switch 52 is a switch manipulated by an operator to switch the control mode, and is disposed in the cab of the hydraulic shovel 1. A control mode of one of "a virtual pump flow rate setting table creation mode," "a virtual bleed-off control mode" and "an open center control mode" to be described later can be arbitrarily selected by the mode switch 52. In the present embodiment, although the mode switch 52 is provided separately from the monitor device 54, it is also possible to adopt a configuration in which the control mode is switched using the operation means of the monitor device 54.

Next, the control performed by the controller 50 will be described with reference to FIGS. 4 to 20.

FIG. 4 illustrates a flow chart of a main routine. When the main routine starts, first, the controller 50 reads the signals of the first and second pump pressure sensors 39L and 39R, the first and second negative control pressure sensors 40L and 40R, the manipulation detecting means 51 and the mode switch 52 in step S1. Next, in step S2, the flow rate control valve is controlled. The control of the flow rate control valve is control that is performed by a flow rate control valve control block 61 to be described later, and each of the flow rate control valves 20 to 27 is controlled based on the manipulation signals of the hydraulic actuator manipulation tool that is input from the manipulation detecting means 51, but the details thereof will be described later. Further, the controller 50 determines a mode selected by the mode switch 52 in step S3. When the "virtual pump flow rate setting table creation mode" is selected, the "virtual pump flow rate setting table creation control" (step S4) is performed, when the "virtual bleed-off control mode" is selected, the "virtual bleed-off control" (step S5) is performed, and when the "open center control mode" is selected, the "open center control" (step S6) is performed.

Here, the "virtual pump flow rate setting table creation control" is a control for creating a "manipulation signal vs. pump flow rate" table used in the "virtual bleed-off control" mode. The table of the "manipulation signal vs. pump flow rate" corresponds to a function table linking the manipulation signal of the hydraulic pump actuator manipulation tool with the pump flow rate of the hydraulic pressure pump according to the present invention, and is created for each of the respective hydraulic actuators A. The "virtual bleed-off control" is a control mode in which the pump flow rate control for operating the hydraulic actuator A is performed by the controller with a responsiveness substantially equal to conventional open center control, while significantly reducing the bleed-off flow rate (the volume of oil flowing to the oil tank 16 from the first and second main pumps 13 and 14 via the first and second center bypass oil passages 29 and 30) by operating the first and second bypass cut valves 31L and 31R. The "open center control" mode performs pump flow rate control using only the negative control pressure generated by throttle valves 32L and 32R based upon the amount of oil passing through the bleed-off openings 20*a* to 27*a* of the hydraulic actuator flow rate control valves 20 to 27.

Next, the "open center control" mode will be described with reference to the flowchart illustrated in FIG. 5. Upon transition to the "open center control," the controller 50 outputs a control command to the first and second bypass cut valves 31L and 31R to be fully opened, and outputs a control command to the first and second negative control pressure output electromagnetic proportional valves 38L and 38R so that the output pressure becomes a minimum pressure (Min pressure, tank pressure) (step S6-1). Although described herein as "control commands" for simplicity of explanation, in actuality first and second bypass cut valves 31L and 31R are preferably configured to fully open when no electrical control signal is provided by controller 50 due the positioning of a spring schematically illustrated in FIG. 2. Likewise, first and second negative control pressure output electromagnetic proportional valves 38L and 38R are preferably configured to move to a position where the input ports 35Lb and 35Rb of shuttle valves 35L and 35R are connected to tank when no electrical control signal is provided by controller 50. Accordingly, a conventional open center control mode can be obtain even when bypass cut valves or negative control pressure output electromagnetic proportional valves are not responsive to control commands due to a short circuit, open circuit or other failure of the electrical solenoids commonly used to operate such valves.

When the first and second bypass cut valves 31L and 31R are fully opened in step S6-1, the bleed-off flow rate flowing through the first and second center bypass oil passages 29 and 30 passes through the fully opened first and second bypass cut valves 31L and 31R and is supplied to the first and second negative control throttles 32L and 32R. Thus, a negative control pressure which increases or decreases according to the passage amount of the bleed-off openings 20 *a* to 27*a* of the hydraulic actuator flow rate control valves 20 to 27 is generated upstream from the first and second negative control throttles 32L and 32R, and the negative control pressure is input to one of the input ports 35La and 35Ra of the first and second shuttle valves 35L and 35R via the first and second negative control lines 34L and 34R. Meanwhile, although the output pressure of the first and second negative control pressure output electromagnetic proportional valves 38L and 38R is input to the other of the input ports 35La and 35Ra of the first and second shuttle valves 35L and 35R, because the output pressure is controlled to a minimum value in step S6-1, the negative control pressure which is input from one of the input ports 35La and 35Ra is output from the first and second shuttle valves 35L and 35R, and is input to the variable displacement means 13 *a* and 14 *a* of the first and second main pumps 13 and 14. Thus, the pump flow rate of the first and second main pumps 13 and 14 is controlled to increase or decrease by the negative control pressure generated according to the passage amount of the bleed-off openings 20 *a* to 27 *a* of h hydraulic actuator flow rate control valves 20 to 27.

Thus, in "open center control," the pump flow rates of the first and second main pumps 13 and 14 are controlled to increase or decrease by the negative control pressure generated according to the passage amount of the bleed-off openings 20*a* to 27*a* of the hydraulic actuator flow rate control valves 20 to 27. In this case, when none of the hydraulic actuators manipulation tools is operated, the bleed-off flow rate passing through the bleed-off openings 20*a* to 27*a* is maximized, the negative control pressure increases, and thus control is performed such that the pump flow rate becomes a minimum flow rate. Meanwhile, when the hydraulic actuator manipulation tool is manipulated, the bleed-off flow rate passing through the bleed-off openings 20*a* to 27*a* decreases according to the operation amount, the negative control pressure decreases, and thus control is performed such that the pump flow rate increases. However, because the conventional control from the related art is adopted, its detailed description will not be provided.

As illustrated in FIG. 18, although the opening area of the first bypass cut valve 31 at the fully opened position N is smaller than the bleed-off opening area of the flow rate control valve CV in the neutral position, the pressure oil flowing through the first and second center bypass oil passages 29 and 30 is not significantly throttled by the fully opened first and second bypass cut valves 31L and 31R. Thus, in the "open center control" mode, substantially the same negative control as in the case in which the first and second bypass cut valves 31L and 31R are not present is performed.

Next, the "virtual pump flow rate setting table creation control" will be described with reference to the flowchart illustrated in FIG. 6. Upon transition to the "virtual pump flow rate setting table creation control," the controller 50 outputs a control signal to the first and second bypass cut valves 31L and 31R to be fully opened, and outputs a control signal to the first and second negative control pressure output electromagnetic proportional valves 38L and 38R so that the output pressure becomes a minimum pressure (Min pressure, tank pressure) (step S4-1). The process of step S4-1 is the same as the control of step S6-1 in the "open center control" described above, and thus the pump flow rates of the first and second main pumps 13 and 14 enter an open center control state in which the pump flow rates are controlled to increase or decrease by the negative control pressure generated according to the passage amount of the bleed-off openings 20*a* to 27*a* of the hydraulic actuator control valves 20 to 27.

After the process of step S4-1, the controller 50 continuously displays any one of the hydraulic actuators A to be operated and a desired initial position of the front working unit 4 according to the hydraulic actuator A on the display 54*a* of the monitor device 54 (step S4-2). The operator turns ON the start switch provided on the manipulation means 54*b* of the monitor device 54 after moving the front working unit 4 to the initial position in accordance with the display of the display 54*a*.

Next, the controller 50 determines whether the start switch was turned on ON (step S4-3). In the case of "NO", that is, when the start switch is not ON, the front working unit 4 is assumed not to be set to the initial position, and the process returns to the step S4-2.

Meanwhile, in the case of "YES" in the determination of step S4-3, that is, when the start switch is ON, the front working unit 4 is determined to be set to the initial position, and the controller 50 automatically increases a manipulation signal to move the hydraulic actuator A displayed on the monitor device 54 from zero to the maximum (full manipulation) at a constant speed (step S4-4). The control of the flow rate control valve CV based on the manipulation signal is performed by a flow rate control valve control block 61 to be described later. However, the spool of the flow rate control valve CV is displaced by increasing the manipulation signal corresponding to the hydraulic actuator A in step S4-4 at a constant speed. Thus, as the pressurized oil is supplied to the hydraulic actuator A, the opening area of the bleed-off opening $CV_a$ of the flow rate control valve CV decreases, and the negative control pressure decreases. The controller 50 stores in a table the manipulation signal and the corresponding sensed value of the negative control pressure detected by a pressure sensor 40L or 40R at that time (step S4-5).

Next, the pump flow rate is determined from the negative control pressure based on predetermined pump flow rate versus negative control pressure characteristics of the first and second main pumps 13 and 14 (step S4-6). The pump flow rate versus the negative control pressure characteristics of the first and second main pumps 13 and 14 are known in advance as illustrated in FIG. 19.

Next, it is determined whether the manipulation signal is at the maximum (full manipulation) (step S4-7). In the case of "NO", that is, when the manipulation signal is not at the maximum, the process returns to step S4-4, and the processes of step S4-4 to Step S4-6 are repeated.

Meanwhile, in the case of "YES" in the determination of step S4-7, that is, when the manipulation signal is at the maximum, a function table of the "manipulation signal vs. pump flow rate" created using the manipulation signal and the pump flow rate determined in step S4-6, is stored in the memory (step S4-8), and is returned.

Thus, in the "virtual pump flow rate setting table creation control," the open center control state is set in the process of step S4-1, and in this state, a table of the "manipulation signal vs. pump flow rate" is created. The table of the created "manipulation signal vs. pump flow rate" is used in the virtual pump flow rate setting in the "virtual bleed-off control" which will be described later.

Further, although the flowchart illustrated in FIG. 6 illustrates a creation procedure of the "manipulation signal vs. pump flow rate" for a single hydraulic actuator, the "manipulation signal vs. pump flow rate" for another hydraulic actuator is also sequentially created in the same procedure.

Next, the "virtual bleed-off control" will be described with reference to FIGS. 7 to 20. The control block diagrams illustrated in FIGS. 7 to 13 illustrate the control relating to the valves, pump and actuators on the right hand side of FIG. 2. However, because the control relating to the valves and actuators on the left hand side of FIG. 2 operate similarly, they will not be further illustrated or described herein.

FIG. 7 is a diagram illustrating a pump and valve control block 60 provided in the controller 50. The pump and valve control block 60 is provided with various blocks including a flow rate control valve control block 61 which controls the left traveling flow rate control valve 20, bucket flow rate control valve 21, first speed boom flow rate control valve 22 and second speed arm flow rate control valve 23 based on a left traveling manipulation signal 51-1, bucket manipulation signal 51-2, boom manipulation signal 51-3 and arm manipulation signal 51-4, these manipulation signals being detected by the manipulation detecting means 51. A bleed-off opening area setting block 62 determines the opening areas of the bleed-off openings 20*a* to 23*a* of each of the flow rate control valves 20 to 23 based on the pilot pressure output electromagnetic proportional valve command value that is output from the flow rate control valve control block 61. A virtual pump flow rate setting block 63 sets a virtual pump flow rate based on the manipulation signals 51-1, 51-2, 51-3 and 51-4. A bypass cut valve setting block 64 sets the opening area of the first bypass cut valve 31L based on the manipulation signals 51-1, 51-2, 51-3 and 51-4. A pump flow rate control block 65 outputs a negative control pressure command based on the first main pump pressure signal 39L-1 received from first pump pressure sensor 39L, and the output signals of the bleed-off opening area setting block 62, the virtual pump flow rate setting block 63 and the bypass cut valve setting block 64. A negative control pressure output electromagnetic proportional valve control block 66 controls the first negative control pressure output electromagnetic proportional valve 38L based on a first negative control pressure signal 40L-1 received from the first negative control pressure sensor 40L and the negative control pressure command that is output from the pump flow rate control block 65. A first signal selector 68 selects one of the output value of the negative control pressure output electromagnetic proportional valve control block 66 and the output value of the Min pressure setter 67 based on the control mode set by mode switch 52. A second signal selector 70 selects one of the output value of the bypass cut valve setting block 64 and the output value of the full open setter 69 based on the control mode set by the mode switch 52. From the flow rate control valve control block 61, control command are output to the pilot pressure output electromagnetic proportional valves 53, including a left traveling forward side electromagnetic proportional valve 53-1*a*, a left traveling reverse side electromagnetic proportional valve 53-1*b*, a bucket closed side electromagnetic proportional valve 53-2*a*, a bucket open side electromagnetic proportional valve 53-2*b*, a first speed boom ascending side electromagnetic proportional valve 53-3*a*, a first speed boom descending side electromagnetic proportional valve 53-3*b*, a second speed arm inside electromagnetic proportional valve 53-4*a*, and a second speed arm outside electromagnetic proportional valve 53-4*b*. Further, control commands are output to the first negative control pressure output electromagnetic proportional valve 38L from the first signal selector 68, and to the first bypass cut valve 31L from the second signal selector 70.

Although the details of the respective blocks 61 to 66 will be described later, the flow rate control valve control block 61 is performed in step S2 of the aforementioned main routine, and is performed in all of the "virtual pump flow rate setting table creation control," the "virtual bleed-off control mode" and the "open center control mode."

The first and second signal selectors 68 and 70 switch the signals based on the control mode that is set by the mode switch 52. When "open center control mode" or "virtual pump flow rate setting table creation control" are set, the minimum pressure (Min pressure, tank pressure) command value of the first negative control pressure output electromagnetic proportional valve 38L output from the Min pressure setter 67, and the full opening command value of the first bypass cut valve 31L output from the full opening setter 69 are each selected by the first and second signal selectors 68 and 70, and thus the processes of the aforementioned steps S6-1 and S4-1 are performed. Alternatively when "virtual bleed-off control" is selected, the output value from the negative control pressure output electromagnetic proportional valve control block 66 and the output value from the bypass cut valve setting block 64 are each selected by the first and second signal selectors 68 and 70.

Next, the flow rate control valve control block 61 will be described based on FIG. 8. In FIG. 8, reference numeral 61-1 denotes a left traveling flow rate control valve control block that outputs the control command to the left traveling forward side electromagnetic proportional valve 53-1*a* and the left traveling reverse side electromagnetic proportional valve 53-1*b* on the basis of the left traveling manipulation signal 51-1. The left traveling flow rate control valve control block 61-1 is configured to include elements such as a positive side manipulation function table 61-1*a* that extracts the positive side (forward side) signal of the left traveling manipulation signal 51-1, a positive side rate limiter 61-1*b* that adjusts the ascending and descending responses of the signal, a left traveling forward side electromagnetic proportional valve command value table 61-1*c* that sets the command value of the left traveling forward side electromagnetic proportional valve 53-1*a* based on the output signal from the positive side rate limiter 61-1*b*, a negative side manipulation function table 61-1*d* that extracts the negative side (reverse side) signal of the left traveling manipulation signal 51-1, a negative side rate limiter 61-1*e* that adjusts the ascending and descending responses of the signal, and a left traveling reverse side electromagnetic proportional valve command value table 61-1*f* that sets the command value of the left traveling reverse side electromagnetic proportional valve 53-1*b* based on the output signal from the negative side rate limiter 61-1*e*.

Also, reference numeral 61-2 denotes a bucket flow rate control valve control block that outputs a control command to the bucket closed side electromagnetic proportional valve 53-2*a* and the bucket open side electromagnetic proportional valve 53-2*b* based on the bucket manipulation signal 51-2, reference numeral 61-3 denotes a first speed boom flow rate control valve that outputs a control command to the first speed boom ascending side electromagnetic proportional valve 53-3*a* and the first speed boom descending side electromagnetic proportional valve 53-3*b* based on the boom manipulation signal 51-3, and reference numeral 61-4 denotes a second speed arm flow rate control valve control block that outputs a control command to the second speed arm inside electromagnetic proportional valve 53-4*a* and the second speed arm outside electromagnetic proportional valve 53-4*b* based on the arm manipulation signal 51-4. Although not illustrated, the bucket flow rate control valve control block 61-2, the first speed boom flow rate control valve 61-3 and the second speed arm flow rate control valve control block 61-4 are configured to include similar elements to the left traveling flow rate control valve control block 61-1.

Furthermore, reference numeral 61-5 denotes a second speed arm restriction table. The second speed arm restriction table 61-5 restricts the arm-in manipulation signal based on the boom ascending side manipulation signal for improvement of the interlocking operability between the boom ascending and the arm-in. The second speed arm-in restriction signal that is output from the second speed arm restriction table 61-5 is input to the Min (minimum value) selector 61-6. Further, the Min selector 61-6 is configured to select the minimum value among the second speed arm-in restriction signal that is output from the second speed arm restriction table 61-5, and the arm-in manipulation signal 51-4 detected by the manipulation detecting means 51, and to output the minimum value as the arm-in manipulation signal to the second speed arm flow rate control valve control block 61-4.

Next, the bleed-off opening area setting block 62 will be described based on FIG. 9. In FIG. 9, reference numeral 62-1 denotes a left traveling bleed-off opening area setting block, reference numeral 62-2 denotes a bucket bleed-off opening area setting block, reference numeral 62-3 denotes a first speed boom bleed-off opening area setting block, and reference numeral 62-4 denotes a second speed arm bleed-off opening area setting block. Each of the bleed-off opening setting blocks 62-1, 62-2, 62-3 and 62-4 inputs the command values of the pilot pressure output electromagnetic proportional valves 53 that are output from the flow rate control valve control block 61, and obtains and outputs the bleed-off opening area Apti of the left traveling flow rate control valve 20, the bucket flow rate control valve 21, the first speed boom flow rate control valve 22 and the second speed arm flow rate control valve 23 based on the command value.

The configurations of each of the bleed-off opening setting blocks 62-1, 62-2, 62-3 and 62-4 will be described. The left traveling bleed-off opening area setting block 62-1 is configured to include elements such as a left traveling forward side bleed-off opening area table 62-1*a* that obtains the bleed-off opening area of the left traveling flow rate control valve 20 based on the command value of the left traveling forward side electromagnetic proportional valve 53-1*a*, a left traveling reverse side bleed-off opening area table 62-1*b* that obtains the bleed-off opening area of the left traveling flow rate control valve 20 based on the command value of the left traveling reverse side electromagnetic proportional valve 53-1*b*, and a Min (minimum value) selector 62-1*c* that selects the minimum value among the bleed-off opening areas obtained by the left traveling forward side bleed-off opening area table 62-1*a* and the left traveling reverse side bleed-off opening area table 62-1*b*. The left traveling bleed-off opening area setting block 62-1 outputs the value selected by the Min selector 62-1*c* as a left traveling bleed-off opening area $A_{pti}$.

Also, although not illustrated, the bucket bleed-off opening area setting block 62-2, the first speed boom bleed-off opening area setting block 62-3, and the second speed arm bleed-off opening area setting block 62-4 include similar elements to the left traveling bleed-off opening area setting block 62-1.

Next, the virtual pump flow rate setting block 63 will be described based on FIG. 10. The virtual pump flow rate setting block 63 inputs the manipulation signals of the left traveling manipulation signal 51-1, the bucket manipulation signal 51-2, the boom manipulation signal 51-3 and the arm manipulation signal 51-4, and calculates and outputs the virtual pump flow rate based on the manipulation signals.

In FIG. 10, reference numeral 63-1 denotes a left traveling virtual pump flow rate setting unit, reference numeral 63-2 denotes a bucket virtual pump flow rate setting unit, reference numeral 63-3 denotes a first speed boom virtual pump flow rate setting unit, and reference numeral 63-4 denotes a second speed arm virtual pump flow rate setting unit. In the virtual pump flow rate setting units 63-1, 63-2, 63-3 and 63-4, the tables of the "manipulation signal vs. pump flow rate" for left traveling, the bucket, the boom and the arm created in the "virtual pump flow rate setting table creation control" are used. The virtual pump flow rate setting units 63-1, 63-2, 63-3 and 63-4 obtain the pump flow rates corresponding to each of the left traveling manipulation signal 51-1, bucket manipulation signal 51-2, boom manipulation signal 51-3 and arm manipulation signal 51-4 using the tables and output the pump flow rate as a virtual pump flow rate.

Reference numeral 63-5 denotes a second speed arm restriction table. The second speed arm restriction table 63-5 restricts the arm-in manipulation signal based on the boom ascending side manipulation signal, for improvement of the interlocking operability between the boom ascending and the arm-in, and the second speed arm-in restriction signal that is output from the second speed arm restriction table is input to the Min (minimum value) selector 63-6. Further, the Min selector 63-6 selects the minimum value among the second speed arm-in restriction signal that is output from the second speed arm restriction table 63-5 and the arm-in manipulation signal detected by the manipulation detecting means 51, and outputs the minimum value as the arm-in manipulation signal to the second speed arm virtual pump flow table 63-4.

In addition, reference numeral 63-7 denotes a Max (maximum value) selector. The Max selector 63-7 selects the maximum value among the virtual pump flow rates that are output from the left traveling virtual pump flow rate setting unit 63-1, the bucket virtual pump flow rate setting unit 63-2, the first speed boom virtual pump flow rate setting unit 63-3 and the second speed arm virtual pump flow rate setting unit 63-4. Adjustment of the rate of change of the pump flow rate may be performed by rate limiter 63-8 to limit the acceleration and deceleration of the hydraulic actuator A, and the adjusted maximum value is output as the virtual pump flow rate $Q_{vp}$ from the virtual pump flow rate setting block 63.

Next, the bypass cut valve setting block 64 will be described based on FIGS. 11 and 18. FIG. 18 is a characteristic diagram illustrating an example of a relationship among the spool displacement amount of the flow rate control valve CV, the PC opening area (opening area of the pressure oil supply opening to the hydraulic actuator A) formed in the flow rate control valve CV, the bleed-off opening area, and the opening area of the first bypass cut valve 31L. As illustrated in FIG. 18, in the "virtual bleed-off control," the first bypass cut valve 31L is closed earlier than the bleed-off opening $CV_a$ to cut the bleed-off flow rate that flows to the oil tank 16 through the first center bypass oil passage 29.

In FIG. 11, reference numeral 64-1 denotes a left traveling bypass cut opening setting block, reference numeral 64-2 denotes a bucket bypass cut opening setting block, reference numeral 64-3 denotes a first speed boom bypass cut opening setting block, and reference numeral 64-4 denotes a second speed arm bypass cut opening setting block. The bypass cut opening setting blocks 64-1, 64-2, 64-3 and 64-4 set the opening area of the first bypass cut valve 31L at the time of operation of the corresponding hydraulic actuator A based on the left traveling manipulation signal 51-1, the bucket manipulation signal 51-2, the boom manipulation signal 51-3 and the arm manipulation signal 51-4, respectively.

The configuration of each of the bypass cut opening setting blocks 64-1, 64-2, 64-3 and 64-4 will be described. The left traveling bypass cut opening setting block 64-1 is configured to include elements such as a forward side manipulation function table 64-1*a* that extracts the positive side (forward side) signal of the left traveling manipulation signal 51-1, a positive side rate limiter 64-1*b* that adjusts the rate of change of the signal, a left traveling forward side bypass cut valve opening area table 64-1*c* that sets the opening area of the first bypass cut valve 31L based on the output signal from the positive side rate limiter 64-1*b*, a negative side manipulation function table 64-1*d* that extracts the negative side (reverse side) signal of the left traveling manipulation signal, a negative side rate limiter 64-1*e* that adjusts the ascending and descending responses of the signal, a left traveling reverse side bypass cut valve opening area table 64-1*f* that sets the opening area of the first bypass cut valve 31L based on the output signal from the negative side rate limiter 64-1*e*, and a Min selector 64-1*g* that selects the minimum value among the output signal of the left traveling forward side bypass cut valve opening area table 64-1*c* and the output signal of the left traveling reverse side bypass cut valve opening area table 64-1*f*. The minimum value selected by the Min selector 64-1*g* is output as the left traveling bypass cut valve opening area.

Further, although it is not illustrated, the bucket bypass cut opening setting block 64-2, the first speed boom bypass cut opening setting block 64-3 and the second speed arm bypass cut opening setting block 64-4 are configured to include similar elements to the left traveling bypass cut opening set block 64-1. The bucket manipulation signal 51-2, the boom manipulation signal 51-3 and the arm manipulation signal 51-4 are input to the blocks to output the bucket bypass cut valve opening area, the first speed boom bypass cut valve opening area, and the second speed arm bypass cut valve opening area, respectively.

Also, reference numeral 64-5 denotes a second speed arm restriction table. The second speed arm restriction table 64-5 restricts the arm-in manipulation signal for improvement of the interlocking operability between the boom ascending and the arm-in based on the boom ascending side manipulation signal. The second speed arm-in restriction signal that is output from the second speed arm restriction table 64-5 is input to the Min (minimum value) selector 64-6. Further, the Min selector 64-6 selects the minimum value among the second speed arm-in restriction signal that is output from the second speed arm restriction table, and the arm-in manipulation signal detected by the manipulation detecting means 51, and outputs the minimum value as the arm-in manipulation signal to the second speed arm bypass cut opening setting block 64-4.

Further, reference numeral 64-7 denotes a Min selector. The Min selector 64-7 selects the minimum value among the bypass cut valve opening areas for the left traveling, bucket, first speed boom and second speed arm that are output from blocks 64-1 to 64-4. Further, the selected minimum value corresponding to a bypass cut valve opening area $A_{bc}$, is converted using bypass cut valve command value table 64-8 into a bypass cut valve command value output from the bypass cut valve setting block 64. When the "virtual bleed-off control mode" is selected by the mode switch 52 as described above, the output value from the bypass cut valve setting block 64 is selected by the second signal selector 70 to control the first bypass cut valve 31L.

FIGS. 16 and 17 illustrate a model diagram of a center bypass oil passage. FIG. 16A is a model diagram illustrating an open center control system. The bleed-off openings CVa (opening area Apti) and the negative control throttles NC (open area $A_{nc}$) of a plurality of flow rate control valves are connected in series to the center bypass oil passage SB of the open center control system. The plurality of bleed-off openings $CV_a$ connected in series can be expressed as a bleed-off opening $CV_a$ of the equivalent bleed-off opening area $A_{ept}$ illustrated in FIG. 16B (a relationship between the opening areas $A_{pti}$ of the plurality of bleed-off openings $CV_a$ and the equivalent bleed-off opening area $A_{ept}$ is expressed by equation (1) to be described later). Further, a pressure difference between the upstream pressure of the bleed-off opening $CV_a$ of the equivalent bleed-off opening area $A_{ept}$ and the downstream side of the negative control throttle NC is a pump pressure $P_p$. Meanwhile, FIG. 17 is a model diagram illustrating a virtual bleed-off control system of the present invention, and in the center bypass oil passage SB of the virtual bleed-off control system, the bypass cut valve BC (opening area $A_{bc}$) is disposed upstream from the negative control throttle NC. In FIGS. 16 and 17, reference numeral P denotes a hydraulic pump, and reference numeral T denotes an oil tank.

In the virtual bleed-off control system, the center bypass oil passage SB is closed by the bypass cut valve BC whenever the manipulation tool manipulation amount is small in order to reduce the bleed-off flow rate. Meanwhile, to operate the hydraulic actuator with performance substantially equal to an open center control system, the pump flow rate is obtained through the following calculation steps (1) to (3).

(1) The bleed-off flow rate of the open center control system illustrated in FIG. 16 is obtained as the virtual bleed-off flow rate on the assumption that the bypass cut valve BC is not present, from the equivalent bleed-off opening area $A_{ept}$ of the flow rate control valve, the negative control throttle opening area $A_{nc}$ and the pump pressure $P_p$.

(2) The bleed-off flow rate of the virtual bleed-off control system illustrated in FIG. 17 is obtained as the actual bleed-off flow rate from the equivalent bleed-off opening area $A_{ept}$ of the flow rate control valve, the negative control throttle opening area $A_{nc}$, the bypass cut valve opening area $A_{bc}$ and the pump pressure $P_p$.

(3) The pump request flow rate for the virtual bleed-off control system required to operate the hydraulic actuator equally with the open center control system is obtained using the formula: pump request flow rate equals virtual pump flow rate minus bleed-off reduction flow rate. The virtual pump flow rate is based on the assumption that the bypass cut valve BC is not present, that is, a pump flow when operating in an open center control mode with the bypass cut valve fully open and not significantly throttle the bleed off flow. The virtual pump flow rate $Q_{vp}$ that is output from the aforementioned virtual pump flow rate setting block 63 may be used as the virtual pump flow rate. Further, the bleed-off reduction flow rate is a difference between the virtual bleed-off flow rate obtained in (1) and the actual bleed-off flow rate obtained in (2). The calculation of steps of (1), (2) and (3) is performed in the pump flow rate control block 65 described based on FIG. 12.

The left traveling, bucket, first speed boom and second speed arm bleed-off opening areas $A_{pti}$ which are output from the bleed-off opening area setting block 62, the virtual pump flow rate $Q_{vp}$ that is output from the virtual pump flow rate setting block 63, the bypass cut valve opening area $A_{bc}$ that is output from the bypass cut valve setting block 64, and a first main pump pressure signal 39L-1 detected by the first pump pressure sensor 39L are input to the pump flow rate control block 65. The pump request flow rate for virtual bleed-off control is obtained based on the input signals.

In FIG. 12, reference numeral 65-1 denotes an equivalent bleed-off opening area calculation block. The equivalent bleed-off opening area calculation block 65-1 obtains the equivalent bleed-off opening area $A_{ept}$ from the left traveling, bucket, first speed boom and second speed arm bleed-off opening areas $A_{pti}$ connected in series, using the following $$A_{ept}=1/\sqrt{\Sigma(1/A_{pti})^2} \quad \text{Equation (1).}$$

Reference numeral 65-3 denotes a virtual center bypass opening area calculation block. The virtual center bypass opening area calculation block 65-3 obtains the virtual center bypass opening area $A_{vpt}$ of the first center bypass passage 29 on the assumption that the first bypass cut valve 31L is not provided, from the opening area $A_{nc}$ of the first negative control throttle 32L stored in the data section 65-2 and the equivalent bleed-off opening area $A_{ept}$ obtained by the equivalent bleed-off opening area calculation block 65-1, using the following $$A_{vpt}=\sqrt{A_{ept}^2\cdot A_{nc}^2/(A_{ept}^2+A_{nc}^2)} \quad \text{Equation (2).}$$

Reference numeral 65-4 denotes an actual center bypass opening area calculation block. The block 65-4 obtains the actual center bypass opening area $A_{apt}$ of the first center bypass passage 29 when first bypass cut valve 31L is operated, based upon the bypass cut valve opening area $A_{bc}$ and the virtual center bypass opening area $A_{vpt}$ obtained in the virtual center bypass opening area calculation block 65-3, using the following $$A_{apt}=\sqrt{A_{vpt}^2\cdot A_{bc}^2/(A_{vpt}^2+A_{bc}^2)} \quad \text{Equation (3).}$$

Further, reference numeral 65-5 denotes a first subtractor, which subtracts the actual center bypass opening area $A_{apt}$ when the first bypass cut valve 31L is operated, from the virtual center bypass opening area $A_{vpt}$ calculated as if the first bypass cut valve 31L were not present, and outputs the subtracted area ($A_{vpt}-A_{apt}$).

Reference numeral 65-6 denotes a band-pass filter. The band-pass filter 65-6 extracts frequency components of the hydraulic system natural frequency from the first main pump pressure signal 39L-1 which is detected by the first pump pressure sensor 39L. A second subtractor 65-7 subtracts the frequency components of the hydraulic system natural frequency extracted by the band-pass filter 65-6 from the first main pump pressure signal 39L-1, and provides a smooth and stable pump pressure signal $P_p$.

In addition, a square root calculator 65-8 obtains the square root of the smoothed pump pressure $P_p$ obtained by the second subtractor 65-7 and multiplies the square root by the coefficient $C_q$ in a gain amplifier 65-9. A first multiplier 65-10 multiplies the area ($A_{vpt}-A_{apt}$) that is output from the first subtractor 65-5 by the output value of the gain 65-9 to obtain a virtual bleed-off flow rate $Q_{vbo}$. The processing of the first subtractor 65-5, the square root calculator 65-8, the gain 65-9 and the first multiplier 65-10 is expressed by the following $$Q_{vbo}=C_q\cdot(A_{vpt}\cdot A_{apt})\cdot\sqrt{P_p} \quad \text{Equation (4).}$$

Further, the coefficient $C_q$ used in the gain 65-9 is expressed by the following $$C_q=c\cdot\sqrt{2/\rho} \quad \text{Equation (5).}$$

In the above equation (5), c is a flow coefficient, and p is a density of the hydraulic fluid.

A third subtractor 65-11 subtracts the virtual bleed-off flow rate $Q_{vbo}$ obtained by the first multiplier 65-10 from the virtual pump flow rate $Q_{vp}$ that is output from the virtual pump flow rate setting block 63 to obtain the pump request flow rate $Q_{rq}$. The frequency components of the hydraulic system natural frequency extracted by the band-pass filter 65-6 are multiplied by the pressure feedback gain $K_p$ in feedback gain block 65-12. A gain compensator 65-13 outputs the gain compensation coefficient based on the equivalent bleed-off opening area $A_{ept}$ that is output from the equivalent bleed-off opening area calculation block 65-1.

As illustrated in FIG. 20, when the equivalent bleed-off opening area $A_{ept}$ is fully closed, or fully opened at the neutral position of all the flow rate control valves 20 to 23, pressure feedback is not required and the gain compensation factor is set to zero. In between those positions, the second multiplier 65-14 multiplies the output value of the gain compensator 65-13 by the output value of the feedback gain block 65-12. A fourth subtractor 65-15 performs pressure feedback of the output value of the second multiplier 65-14 to the pump request flow rate $Q_{rq}$ obtained by the third subtractor 65-11 to set a pump flow rate command value $Q_{pcd}$. A negative control pressure command table 65-16 created based upon known pump flow rate versus negative control pressure characteristics converts the pump flow rate command value $Q_{pcd}$ into a negative control pressure command value, and the negative control pressure command value is output from the pump flow rate control block 65.

Next, the negative control pressure output electromagnetic proportional valve control block 66 will be described based on FIG. 13. The negative control pressure command that is output from the pump flow rate control block 65, and an actual negative control pressure signal 40L-1 detected by the first negative control pressure sensor 40L are input to the negative control pressure output electromagnetic proportional valve control block 66.

In FIG. 13, reference numeral 66-1 denotes an electromagnetic proportional valve characteristic table illustrating a relationship between a given negative control pressure command value and the negative control pressure output electromagnetic proportional valve command value, and the negative control pressure output electromagnetic proportional valve command value is obtained from the negative control pressure command value using the electromagnetic proportional valve characteristic table 66-1.

A subtractor 66-2 feeds the actual negative control pressure detected by the first negative control pressure sensor 40L back to the negative control pressure command, and performs a control operation such as PID control by the control unit 66-3. Further, an adder 66-4 adds the output value of the electromagnetic proportional valve characteristic table 66-1 and the output value of the control unit 66-3, and outputs the added value as the command of the first negative control pressure output electromagnetic proportional valve 38L from the negative control pressure output electromagnetic proportional valve control block 66. When the "virtual bleed-off control mode" is selected by the mode switch 52 as described above, the output value from the negative control pressure output electromagnetic proportional valve control block 66 is selected by the first signal selector 68 to control the first negative control pressure output electromagnetic proportional valve 38L.

Next, an exemplary rate limiter 71 will be described based on the calculation block diagram of FIG. 14. Rate limited 71 is illustrative of positive side and negative side rate limiters 61-1*b* and 61-1*e* in the flow rate control valve control block 61, rate limiter 63-8 in the virtual pump flow rate setting block 63, and positive side and negative side rate limiters 64-1*b* and 64-1*e* in the bypass cut valve setting block 64.

In FIG. 14, reference numeral 71-1 denotes a subtractor, reference numeral 71-2 denotes a limiter that limits the output of the subtractor 71-1, and reference numeral 71-3 is an integrator with a reset function. When the positive side restriction value of the limiter 71-2 increases, the output rapidly rises, and when the positive side restriction value decreases, the rise is delayed. Further, when the negative side restriction value of the limiter 71-2 decreases, the output is rapidly returned to the neutral state, and when the negative side restriction value increases, the return to the neutral state is delayed. The integration is reset in the integrator with the reset function 71-3 when the signal of the opposite side rises. For example, when the arm-out manipulation is suddenly performed after an arm-in operation, the arm-out manipulation signal rises, and the arm in signal can be quickly forced back to zero. Because the pump flow rate signal does not have a negative direction, the reset function is not required for the integrator of the rate limiter 63-8 used in the virtual pump flow rate setting block 63.

In the present embodiment, through the rate limiter process performed by the rate limiter 71 in the flow rate control valve control block 61 and the bypass cut valve setting block 64, the opening and closing timings of the flow rate control valve CV and the first bypass cut valve 31L are adjusted and the results are illustrated in FIG. 15.

In a lower diagram of FIG. 15, the dotted line illustrates a case in which a rate limit process is not performed, and the solid line illustrates a case in which the rate limit process is performed. In the case in which rate limit process is not performed, when the hydraulic actuator manipulation tool is manipulated in stages, the first bypass cut valve 31L is closed before the PC opening (the pressure oil supply opening to the hydraulic actuator A) of the flow rate control valve CV is sufficiently opened. For this reason, there is a failure in which the discharged oil from the first main pump 13 is confined, the pump pressure rises, and the main relief valve 47 blows. Likewise, when the manipulation tool is returned to the neutral position, the first bypass cut valve 31L does not begin to open until the PC opening is almost closed and a similar failure results.

Accordingly, a rate limiter process of adjusting the opening and closing timings of the PC opening of the flow rate control valve CV and the first bypass cut valve 31L is performed. That is, the rate limiter process is performed such that, when the manipulation tool is manipulated from a neutral position to a full manipulation side (when the PC opening is opened), the first bypass cut valve 31L is operated to be slower than the flow rate control valve CV, and meanwhile, when the manipulation tool is manipulated from the full manipulation side to the neutral position (when the PC opening is closed), the first bypass cut valve 31L is operated to be faster than the flow rate control valve CV. In FIG. 15, when the PC opening is closed, both of the flow rate control valve CV and the first bypass cut valve 31L are operated to be slower than a case in which the rate limiter process is not performed, but the degree of delay of the first bypass cut valve 31L is small, and thus the first bypass cut valve 31L is operated to be faster than the flow rate control valve CV. When such a rate limiter process is performed, even when the manipulation tool is manipulated in stages, the first bypass cut valve 31L is not closed until the PC opening area of the flow rate control valve CV is fully opened. Further, when the manipulation tool is returned to the neutral position, the PC opening is not closed until after first bypass cut valve 31L is fully opened, and thus it is possible to reliably eliminate a failure in which the discharge oil of the first main pump 13 is confined and the pump pressure suddenly rises.

Thus, in the "virtual bleed-off control," according to the control command that is output from the controller 50, the first bypass cut valve 31L is operated based on the manipulation of the hydraulic actuator manipulation tool to close the first center bypass oil passage 29, and the bleed-off flow rate of the first center bypass oil passage 29 is reduced. Meanwhile, the virtual negative control pressure is output from the first negative control pressure output valve 31L, and the virtual negative control pressure is guided to the variable displacement means 13*a* of the first main pump 13 by the first shuttle valve 35L to control the increase or decrease in the displacement and consequently pump flow rate of the first main pump 13. The controller 50 obtains a difference between the virtual bleed-off flow rate on the assumption that the first bypass cut valve 31L is not present and the actual bleed-off flow rate at the time of operation of the first bypass cut valve 31L, the pump request flow rate is obtained as a bleed-off reduction flow rate by subtracting the bleed-off reduction flow rate from the virtual pump flow rate on the assumption that the first bypass cut valve 31L is not provided, and the first negative control pressure output valve 38L is controlled to set the discharge flow rate of the hydraulic pump as the pump request flow rate. Thus, even in the "virtual bleed-off control," a pump flow rate equivalent to open center control is supplied to the hydraulic actuator A so that the hydraulic actuator A can be equally operated.

INDUSTRIAL APPLICABILITY

In the virtual bleed-off control performed by the controller 50, it is possible to reduce the bleed-off flow rate flowing to the oil tank 16 from the first and second center bypass oil passages 29 and 30, and to reduce the discharge flow rate of the first and second main pumps 13 and 14 by the bleed-off reduction flow rate, which can contribute to energy saving. Moreover, the supply flow rate to the hydraulic actuator A is equivalent to the supply flow rate to the hydraulic actuator A in the conventional open center control system in which the first and second bypass cut valves 31L and 31R are not provided, and thus it is possible to operate the hydraulic actuator A equally to open center control even in the virtual bleed-off control.

Further, in this configuration, when the bypass cut valves 31L and 31R and negative control pressure output electromagnetic proportional valves 38L and 38R are not operated, the negative control pressure generated by the first and second negative control throttles 32L and 32R is guided to the variable displacement means 13*a* and 14*a* of the first and second main pumps 13 and 14. Thus, if any of the bypass cut valves, negative control pressure output valves or pressure sensors break down, or when the bleed-off flow rate is small because a hydraulic actuator manipulation tool is fully operated, it is possible to perform the open center control in which the pump flow rate is controlled only by the negative control pressure generated by the first and second negative control throttles 32L and 32R without any problem.

Furthermore, the present invention has a simple configuration in which the first and second bypass cut valves 31L and 31R, and the first and second negative control pressure output electromagnetic proportional valves 38L and 38R are added to the hydraulic circuit of a conventional open center control system. Because the present invention is configured to perform virtual bleed-off control using the flow rate control valves of existing open center control systems, the necessary physical changes to the hydraulic circuit are also easy, which can significantly contribute to the cost suppression.

Moreover, the controller 50 sets the virtual pump flow rate on the assumption that the first and second bypass cut valves 31L and 31R are not provided, in accordance with the manipulation amount of the hydraulic actuator manipulation tool, using a function table between the manipulation signal of the hydraulic actuator manipulation tool and the pump flow rate of the first and second main pumps 13 and 14, the function table is created in advance based on the detected value of the negative control pressure generated by the first and second negative control throttles 32L and 32R while the manipulation signal of the hydraulic actuator manipulation tool is changed and the bypass cut valves and negative control pressure output electromagnetic proportional valves 38L and 38R are not operated, that is, in the open center control state. Thus, the virtual pump flow rate is based on the actual pump flow rate in the open center control, and thus it is possible to more reliably set the operation of the hydraulic actuator in the virtual bleed-off control to be equivalent to the open center control.

Furthermore, the controller 50 is configured to calculate the bleed-off reduction flow rate based on the bleed-off opening area $CV_a$ of the flow rate control valve CV, the opening areas of the first and second bypass cut valves 31L and 31R, and the pump pressures of the first and second main pumps 13 and 14. However, in this case, the band-pass filtering process for extracting the frequency component of the hydraulic system natural frequency from the pump detection pressure detected by the first and second pump pressure sensors 39L and 39R is performed, and the smooth and stable pressure obtained by subtracting the extracted frequency component from the pump detection pressure is used as the pump pressures of the first and second main pumps 13 and 14. Thus, it is possible to suppress frequency fluctuation of the calculated bleed-off reduction flow rate, and hunting of the pump pressure can be prevented.

Furthermore, the controller 50 is configured to perform the pressure feedback of the frequency components extracted by the band-pass filtering process when the pump request flow rate is obtained. Thus, the damping coefficient in the transfer function between the pump flow rate and the hydraulic actuator speed increases and the hydraulic system is stable, which can contribute to suppression of hunting.

Furthermore, the controller 50 is configured to perform the rate limiter process to operate the first and second bypass cut valves 31L and 31R to be slower than the flow rate control valve CV when the PC opening is opened, and to operate the first and second bypass cut valves 31L and 31R to be faster than the flow rate control valve CV when the PC opening is closed. Thus, the rise of the pump pressure of the first and second main pumps 13 and 14 becomes smooth, and the operability is improved. Further, when the manipulation tool is operated in stages, or when a reversing operation of suddenly switching the manipulation tool in the opposite direction is performed, it is possible to avoid the failure in which the discharge oil of the first and second main pumps 13 and 14 is confined and the pump pressure rapidly rises to the relief pressure.

Furthermore, the controller 50 is configured to feed back the actual negative control pressure detected by the first and second negative control pressure sensors 40R and 40L when controlling the first and second negative control pressure output electromagnetic proportional valves 38L and 38R. Thus, it is possible to reduce the hysteresis and improve responsiveness and controllability of the negative control pressure output electromagnetic proportional valves 38L and 38R.

Of course, the invention is not limited to the above embodiments. For example, in the above embodiments, two main hydraulic pumps are provided, but the present invention can be performed when the number of the hydraulic pumps is one or three or more. In this case, one or three or more each of the center bypass oil passage, negative control throttle, bypass cut valve, negative control pressure output valve, and shuttle valve are also provided.

The present invention can be used to control the hydraulic pump in a hydraulic working machine such as a hydraulic excavator. Further, the present invention can be applied to the hydraulic pump control of various hydraulic working machines, without being limited to the hydraulic shovel.

The invention claimed is:

1. A hydraulic pump control system of a hydraulic working machine comprising:

a variable displacement hydraulic pump having a variable displacement means for varying the hydraulic pump displacement;

a hydraulic actuator to which a pressure oil is supplied from the hydraulic pump;

an open center type flow rate control valve that has a bleed-off opening configured to allow a pump flow rate to flow to an oil tank at a neutral position, and controls the supply flow rate from the hydraulic pump to the hydraulic actuator based on the manipulation of a hydraulic actuator manipulation tool;

a center bypass oil passage that extends from the hydraulic pump to the oil tank via the bleed-off opening of the flow rate control valve; and a negative control throttle that is disposed in the center bypass oil passage downstream from the bleed-off opening to generate a negative control pressure;

a bypass cut valve that is disposed upstream from the negative control throttle to reduce flow through the center bypass oil passage when operated;

a negative control pressure output valve that is operated to output a virtual negative control pressure;

a control means controls the operation of the bypass cut valve and the negative control pressure output valve, wherein the control means:

performs virtual bleed-off control in which the bypass cut valve is operated based on the manipulation of the hydraulic actuator manipulation tool to reduce a bleed-off flow rate flowing to the oil tank from the center bypass oil passage, determines a bleed-off reduction flow rate based upon a difference between a virtual bleed-off flow rate obtained on the assumption that the bypass cut valve is not present and an actual bleed-off flow rate at the time of operation of the bypass cut valve, obtains a pump request flow rate by subtracting the bleed-off reduction flow rate from a virtual pump flow rate obtained on the assumption that the bypass cut valve is present, operates the negative control pressure output valve to output the virtual negative control pressure based upon the pump request flow rate; and a negative control pressure introduction means that selectively guides one of the negative control pressure generated by the negative control throttle or the virtual negative control pressure that is output from the negative control pressure output valve to the variable displacement means of the hydraulic pump.

2. The hydraulic pump control system of the hydraulic working machine according to claim 1, wherein:

the control means sets the virtual pump flow rate obtained on the assumption that the bypass cut valve is not present in accordance with a predetermined relationship between a manipulation amount of the hydraulic actuator manipulation tool and a pump flow rate of the hydraulic pump.

3. The hydraulic pump control system of the hydraulic working C machine according to claim 2, wherein:

the predetermined relationship between a manipulation amount of the hydraulic actuator manipulation tool and a pump flow rate of the hydraulic pump is stored as a function table, and the control means creates the table based on a detected value of the negative control pressure generated by the negative control throttle when the manipulation signal of the hydraulic actuator manipulation tool is changed and known pump flow rate characteristics corresponding to the detected negative control pressure, in an open center control mode in which the bypass cut valve and the negative control pressure output valve are not operated.

4. The hydraulic pump control system of the hydraulic working machine according to claim 1, wherein the control means:

performs a band-pass filtering process of calculating a bleed-off reduction flow rate based on a bleed-off opening area of the pump flow rate control valve, an opening area of the bypass cut valve and the pump pressure of the hydraulic pump, extracts a frequency component of a hydraulic system natural frequency from a pump detection pressure detected by a pressure detecting means for detecting the discharge pressure of the hydraulic pump when the calculation is performed, and uses a pressure obtained by subtracting the extracted frequency component from the pump detection pressure as the detected pump pressure of the hydraulic pump.

5. The hydraulic pump control system of the hydraulic working machine according to claim 4, wherein the control means performs pressure feedback of the frequency component extracted by the band-pass filtering process when the pump request flow rate is obtained.

6. The hydraulic pump control system of the hydraulic working machine according to claim 1, wherein the control means:

performs a rate limiter process for adjusting opening and closing timings of a hydraulic actuator pressure oil supply opening provided in the flow rate control valve and the opening of the bypass cut valve, operates the bypass cut valve to be slower than the flow rate control valve when the hydraulic actuator pressure oil supply opening is opened, and operates the bypass cut valve to be faster than the flow rate control valve when the hydraulic actuator pressure oil supply opening is closed.

7. The hydraulic pump control system of the hydraulic working machine according to claim 1, further comprising:

pressure detecting means for detecting the negative control pressure provided to the variable displacement means, wherein the control means feeds hack the detected pressure when controlling the negative control pressure output valve.

8. The hydraulic pump control system of the hydraulic working machine according to claim 1, wherein the negative control pressure introduction means comprises:

a shuttle valve for selecting the higher pressure side among the pressure generated by the negative control throttle and the pressure output by the negative control pressure output valve, and outputting the selected pressure to the variable displacement means of the hydraulic pump.

9. The hydraulic pump control system of the hydraulic working machine according to claim 1, wherein the control means allows the bypass cut valve to fully open and allows the negative control pressure output valve to connect an input of the negative control pressure introduction means to tank in an open center control mode.

* * * * *